US008633953B2

(12) United States Patent
Kishi

(10) Patent No.: US 8,633,953 B2
(45) Date of Patent: Jan. 21, 2014

(54) DEVELOPER CARTRIDGE FOR IMAGE-FORMING DEVICE

(75) Inventor: Isao Kishi, Nagoya (JP)

(73) Assignee: Brother Kogyo Kabushiki Kaisha, Nagoya-shi (JP)

( * ) Notice: Subject to any disclaimer, the term of this patent is extended or adjusted under 35 U.S.C. 154(b) by 0 days.

(21) Appl. No.: 13/038,497

(22) Filed: Mar. 2, 2011

(65) Prior Publication Data

US 2011/0150527 A1 Jun. 23, 2011

Related U.S. Application Data

(63) Continuation of application No. 11/410,942, filed on Apr. 26, 2006, now Pat. No. 7,924,299.

(30) Foreign Application Priority Data

| | | |
|---|---|---|
| Apr. 26, 2005 | (JP) | 2005-128502 |
| May 11, 2005 | (JP) | 2005-138729 |
| May 13, 2005 | (JP) | 2005-140893 |
| Jun. 3, 2005 | (JP) | 2005-164321 |

(51) Int. Cl.
*B41J 2/385* (2006.01)
*B41J 2/00* (2006.01)
*B41J 2/435* (2006.01)

(52) U.S. Cl.
USPC ..... 347/140; 347/138; 347/152; 347/245; 347/263

(58) Field of Classification Search
None
See application file for complete search history.

(56) References Cited

U.S. PATENT DOCUMENTS

| | | | |
|---|---|---|---|
| 5,485,244 | A | 1/1996 | Gotoda et al. |
| 5,532,790 | A | 7/1996 | Akazawa |
| 5,606,406 | A | 2/1997 | Ikeyama et al. |
| 5,655,175 | A | 8/1997 | Oshida |
| 5,752,132 | A | 5/1998 | Hazama et al. |

(Continued)

FOREIGN PATENT DOCUMENTS

| | | |
|---|---|---|
| CN | 1172290 | 2/1998 |
| CN | 1501195 A | 6/2004 |

(Continued)

OTHER PUBLICATIONS

JP Office Action mailed May 18, 2010, JP Appln. 2005-128502, English Translation.

(Continued)

*Primary Examiner* — Matthew Luu
*Assistant Examiner* — Kendrick Liu
(74) *Attorney, Agent, or Firm* — Banner & Witcoff, Ltd.

(57) ABSTRACT

A developer cartridge provided in an image-forming device has a developer side casing that includes a toner-accommodating chamber and a developing chamber; and a plate wall disposed in the developing chamber for partitioning a thickness-regulating blade from the toner-accommodating chamber. When a thickness-regulating blade scrapes excess charged toner off the developing roller, the plate wall prevents this charged toner from returning to the toner-accommodating chamber. A flexible wiper for cleaning toner detection windows is attached to an agitator for stirring toner in the toner-accommodating chamber via a fixing member. The fixing member includes a support plate and a gripping plate disposed opposite each other with a slit formed therebetween. The wiper is inserted into the slit and is fixed to the fixing member when a boss protruding from a restricting plate becomes inserted into a through-hole formed in the wiper.

12 Claims, 23 Drawing Sheets

(56) References Cited

U.S. PATENT DOCUMENTS

| | | | | |
|---|---|---|---|---|
| 5,758,241 | A | 5/1998 | Oyama et al. | |
| 5,805,965 | A | 9/1998 | Tsuda et al. | |
| 5,913,097 | A | 6/1999 | Nakano et al. | |
| 6,026,263 | A | 2/2000 | Nakahata et al. | |
| 6,226,476 | B1 * | 5/2001 | Miyabe et al. | 399/111 |
| 6,256,471 | B1 | 7/2001 | Sato et al. | |
| 6,304,735 | B1 | 10/2001 | Nishimura et al. | |
| 6,337,956 | B1 | 1/2002 | Sato et al. | |
| 6,360,288 | B1 | 3/2002 | Sutherland et al. | |
| 6,868,247 | B2 | 3/2005 | Sato et al. | |
| 2004/0114961 | A1 * | 6/2004 | Yoshino et al. | 399/119 |
| 2005/0002684 | A1 | 1/2005 | Suzuki | |
| 2006/0051135 | A1 | 3/2006 | Sato et al. | |
| 2007/0009281 | A1 * | 1/2007 | Sato et al. | 399/90 |

FOREIGN PATENT DOCUMENTS

| | | | |
|---|---|---|---|
| EP | 0655662 | A2 | 5/1995 |
| EP | 0770931 | A2 | 5/1997 |
| EP | 1494090 | A2 | 1/2005 |
| JP | 02-011493 | | 1/1990 |
| JP | 5-53436 | | 3/1993 |
| JP | 5-107925 | | 4/1993 |
| JP | 07-152237 | A | 6/1995 |
| JP | 07-295315 | | 11/1995 |
| JP | 08-083645 | | 3/1996 |
| JP | 8-123192 | A | 5/1996 |
| JP | 9-43925 | | 2/1997 |
| JP | 9-088443 | A | 3/1997 |
| JP | 10-116014 | | 5/1998 |
| JP | 11-249398 | | 9/1999 |
| JP | 2000-98719 | | 4/2000 |
| JP | 2000-207364 | A | 7/2000 |
| JP | 2000-250296 | | 9/2000 |
| JP | 2000-250301 | | 9/2000 |
| JP | 2000-275948 | | 10/2000 |
| JP | 2000-275948 | A | 10/2000 |
| JP | 2001-5276 | | 1/2001 |
| JP | 2001-5288 | | 1/2001 |
| JP | 2002-156783 | A | 5/2002 |
| JP | 2002-328512 | A | 11/2002 |
| JP | 2002-367695 | A | 12/2002 |
| JP | 2003-124650 | A | 4/2003 |
| JP | 2003-280360 | | 10/2003 |
| JP | 2003-280475 | A | 10/2003 |
| JP | 2003-287948 | | 10/2003 |
| JP | 2004-69885 | | 3/2004 |
| JP | 2004-86213 | | 3/2004 |
| JP | 2004-205733 | A | 7/2004 |
| JP | 2005-24811 | | 1/2005 |
| JP | 2005-070159 | A | 3/2005 |

OTHER PUBLICATIONS

Extended EP Search Report dared Feb. 17, 2010, EP Appln. 06008532.1.

Partial EP Search Report dtd Nov. 11, 2009, EP Appln. 06008532.1.

Japanese Office Action dated May 21, 2008 for Japanese Application No. 2005-140893, English translation.

Chinese Office Action, mailed Jun. 20, 2008, in corresponding Chinese Application No. 2006100792754.

CN Office Action dtd Feb. 9, 2001, CN Appln. 200910145248.6, English translation.

CN Office Action dated Feb. 21, 2012, corresponding Application No. 200910145248.6; English Translation.

CN Office Action dated Dec. 7, 2011,corresponding Application No. 200910145258.X; English Translation.

US Office Action mailed Jul. 19, 2012, U.S. Appl. No. 12/768,816.

US Office Action mailed Jul. 3, 2012, U.S. Appl. No. 12/768,809.

US Office Action mailed Jan. 15, 2013, U.S. Appl. No. 12/768,809.

Notice of Allowance mailed Jan. 11, 2013, U.S. Appl. No. 12/768,816.

* cited by examiner

DEVELOPER CARTRIDGE FOR IMAGE-FORMING DEVICE

CROSS REFERENCE TO RELATED APPLICATIONS

The present application is a continuation of U.S. patent application Ser. No. 11/410,942, filed Apr. 26, 2006, which claims priority to Japanese Patent Application Nos. 2005-128502, filed Apr. 26, 2005; 2005-138729, filed May 11, 2005; 2005-140893, filed May 13, 2005; and 2005-164321, filed Jun. 3, 2005, the entire contents of which are hereby incorporated by reference into the present application.

TECHNICAL FIELD

The invention relates generally to an image-forming device, such as a laser printer, and more particularly, to a developer cartridge and process cartridge mounted in the image-forming device.

BACKGROUND

Conventional electrophotographic image-forming devices such as laser printers that employ a nonmagnetic, single-component developing method generally include a photosensitive drum on which electrostatic latent images are formed, and a developer cartridge for tribocharging and supplying toner to the photosensitive drum in order to develop the electrostatic latent image formed thereon.

One such developer cartridge disclosed in Japanese Patent Application Publication No. 2000-275948 includes a toner-accommodating chamber for accommodating the toner, and a developing chamber for accommodating a supply roller, a developing roller, and a thickness-regulating blade. A partitioning wall in which an opening is formed divides the developer cartridge into the toner-accommodating chamber and the developing chamber.

This type of developer cartridge also includes an agitator disposed in the toner-accommodating chamber for stirring toner therein. The toner stirred by the agitator is discharged toward the developing chamber through the hole formed in the partitioning wall. The supply roller supplies the discharged toner onto the developing roller while the toner is tribocharged between the two rollers. The thickness-regulating blade scrapes off excess charged toner carried on the developing roller so that the developing roller carries a thin layer on the surface thereof.

A developing device disclosed in Japanese Patent Application Publication No. 2000-250296 includes transparent windows provided at opposing two sides of the toner-accommodating chamber for detecting the amount of residual toner. A cleaning member is further provided on the agitator for cleaning the windows.

A developer cartridge disclosed in Japanese Patent Application Publication No. 2005-24811 supports the shaft of the agitator with a support part having a hollow groove part and a restricting part, the hollow groove part having a guiding portion and a deepest portion. When assembling the agitator, the shaft of the agitator is guided downward along the guiding portion of the hollow groove to the deepest portion, passing over the restricting part, and is maintained in the deepest portion by the restricting part.

The above-described conventional developer cartridges have various disadvantages. One disadvantage is that the charged excess toner that the thickness-regulating blade scrapes off the surface of the developing roller accumulates in the developing chamber and sometimes returns to the toner-accommodating chamber. As the ratio of previously charged toner to uncharged toner increases, charge control becomes difficult when tribocharging the toner between the supply roller and the developing roller, leading to a decline in image quality. Therefore, it is desirable to supply as much of the toner that has been previously charged for development as quickly as possible.

Another disadvantage is that the number of parts required for fixing the cleaning member to the agitator increases, making the assembly process more complex. Further, it is difficult to cleanly peel off the cleaning member from the agitator for recycling when the cleaning member has been fixed with double-sided tape.

With the above-described structure for supporting the shaft of the agitator, there is a danger that the shaft could become damaged when sliding over the restricting part due to a large load being applied to the shaft when the shaft flexes.

Still another disadvantage is that by forming the opening in the casing of the developer cartridge described above for exposing the developing roller, the peripheral edges of the opening are inevitably weaker. Hence, when the user grips the casing near the opening when mounting or removing the developer cartridge, the casing deforms (flexes), which may cause damage to the developing roller or force toner out through a gap formed between the developing roller and the casing.

SUMMARY

In view of the foregoing, it is an object of the invention to provide a developer cartridge capable of preventing a decline in image quality.

It is another object of the invention to provide a developer cartridge having a cleaning member fixed to an agitating member through a simple construction.

It is still another object of the invention to provide a developer cartridge that reduces the risk of damage to the shaft of the agitator when the agitator is mounted in the developer cartridge.

It is yet another object of the invention to provide a developer cartridge having a casing that is reinforced along an opening therein and that reliably maintains a precise gap between the developing roller and an edge of the opening.

It is another object of the invention to provide a process cartridge and an image-forming device in which the developer cartridge that attains at least one of the above-described objects is mounted.

The above and other others will be attained by a developer cartridge including:

a developer-accommodating chamber that accommodates developer;

a developer-carrying member that carries developer;

a supplying member that charges and supplies developer accommodated in the developer-accommodating chamber to the developer-carrying member;

a thickness-regulating member that contacts the developer-carrying member at a contact part with pressure to regulate a thickness of developer carried on the developer-carrying member; and a wall having a base end and a distal end and disposed between the developer-accommodating chamber and the thickness-regulating member, the distal end of the wall being positioned closer to the supplying member than the base end of the wall, the wall partitioning the thickness-regulating member from the developer-accommodating chamber such that a distance between the supplying member and the distal end of the wall is shorter than a distance between the supplying member and the contact part at which the thickness-regulating member contacts the developer-carrying member.

With this construction, the wall provided between the developer-accommodating chamber and the thickness-regulating member partitions the thickness-regulating member from the developer-accommodating chamber. The wall is disposed so that the distance between the supplying member and the distal end of the wall is shorter than the distance between the supplying member and the contact part at which the thickness-regulating member contacts the developer-carrying member. Therefore, when the thickness-regulating member scrapes excess developer off the developer-carrying member to regulate the thickness of developer carried on the developer-carrying member, this developer remains between the thickness-regulating member and the wall and can once again be supplied to the developer-carrying member and regulated by the pressing contact of the thickness-regulating member. As a result, since developer scraped off by the thickness-regulating member, that is, developer carrying a static charge, can be prevented from returning to the developer-accommodating chamber, it is possible to control the charge of the developer reliably in order to prevent a decline in image quality.

The invention described above can reliably tribocharge the developer. Further, the supplying member can easily return previously charged developer to the developer-carrying member, while also easily supplying uncharged developer accommodated in the developer-accommodating chamber to the developer-carrying member.

According to another aspect of the invention, there is provided a developer cartridge including:

a developer-accommodating chamber that accommodates developer;

at least one window that detects an amount of developer remaining in the developer-accommodating chamber;

a cleaning member that cleans the window;

an agitating member that stirs the developer accommodated in the developer-accommodating chamber; and a fixing member disposed on the agitating member and having a slit formed therein, the fixing member fixing the cleaning member when the cleaning member is inserted into the slit.

With this construction, by inserting the cleaning member through the slit in the fixing member, the cleaning member is fixed to the agitating member via the fixing member. This construction eliminates the need for extra parts for fixing the cleaning member and agitating member, enabling the cleaning member to be fixed to the agitating member through a simple assembly process. Accordingly, the invention reduces the number of required parts and improves the efficiency of the assembly operation. Further, since the cleaning member is fixed to the fixing member by insertion through the slit, the cleaning member can also be easily removed, improving the suitability of the cleaning member for recycling.

According to still another aspect of the invention, there is provided a developer cartridge including:

a developer-accommodating chamber that accommodates developer;

an agitator that has an agitator shaft and is disposed inside the developer-accommodating chamber; and a shaft support unit that supports at least one end of the agitator shaft, the shaft support unit comprising:

a holding part that is formed as a recess in an inner wall of the developer-accommodating chamber and rotatably holds the agitator shaft;

a guiding groove that is open on one end and guides the agitator shaft toward the holding part; and a restricting part that restricts movement of the agitator shaft held in the holding part at a border between the guiding groove and the holding part, the guiding groove guiding the agitator shaft toward the restricting part from a position shallower in the inner wall of the developer-accommodating chamber than the holding part with respect to the recessed direction of the holding part.

Since the guiding groove guides the agitator shaft toward the restricting part from a position shallower in the inner wall than the holding part in the recessed direction, the agitator shaft requires less flexing to slide over the restricting part from the guiding groove when mounting the agitator in the developer cartridge, thereby reducing the load applied to the agitator shaft and decreasing the risk of damage to the agitator shaft. Further, since little force of resistance is applied against the agitator shaft sliding over the restricting part from the guiding groove, the agitator shaft can be easily mounted.

According to yet another aspect of the invention, there is provided a developer cartridge including:

a developer-carrying member having a peripheral surface on which developer is carried;

a casing that has an opening formed therein and supports the developer-carrying member in an exposed position in the opening, the opening having an edge; and a reinforcing member that is substantially formed in a box-shape and is disposed along the edge of the opening for reinforcing the edge.

This construction provides the casing with the box-shaped reinforcing part along the edges of the opening in which the developer-carrying member is exposed, thereby effectively reinforcing the edge of the opening, which portion of the casing has less strength. Further, since the reinforcing part is formed in a box shape, the thickness of the casing provided with the reinforcing part can be equivalent to the thickness of the casing in regions other than the reinforcing part, reducing the likelihood of sinks forming during the molding process in the surface opposing the developer-carrying member. Therefore, the opening of the casing can be reliably reinforced while maintaining a precise gap between the developer-carrying member and the edge of the opening.

The construction described above prevents deformation of the casing when a user grips the casing near the opening, thereby effectively preventing damage to the developing roller and preventing developer from leaking through the gap formed between the developing roller and the casing.

BRIEF DESCRIPTION OF THE DRAWINGS

The particular features and advantages of present invention as well as other objects will become apparent from the following description taken in connection with the accompanying drawings, in which.

DETAILED DESCRIPTION

Figure 1:
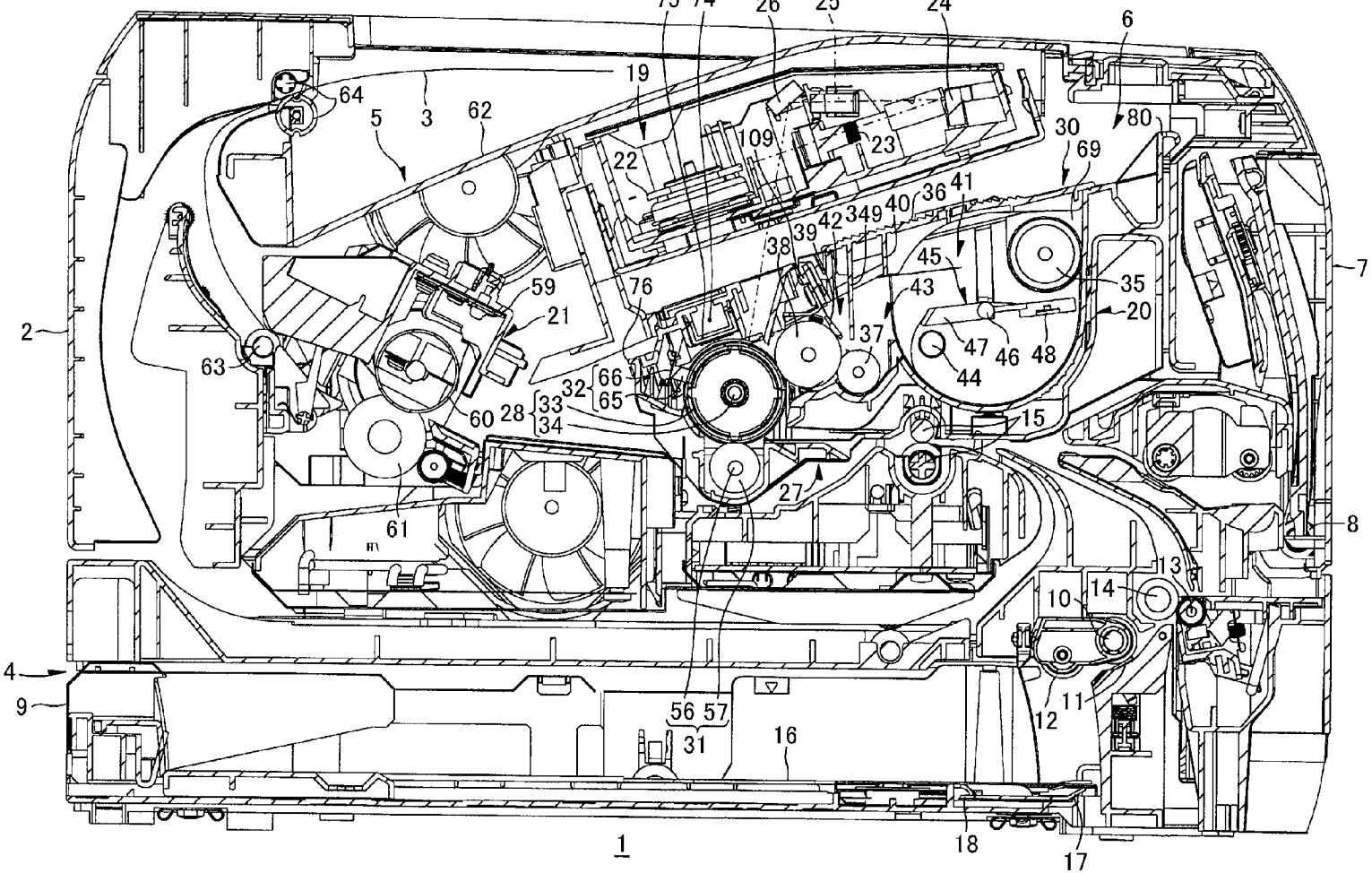
FIG. 1 is a side cross-sectional view of a laser printer serving as the image-forming device of the invention.

A general structure of a laser printer will be described. As shown in FIG. 1, the laser printer 1 serving as the image-forming device of the invention includes a main casing 2 and, within the main casing 2, a feeding unit 4 for supplying sheets of a paper 3, an image-forming unit 5 for forming images on the paper 3 supplied by the feeding unit 4.

(1) Main Casing

The laser printer 1 also includes an access opening 6 formed in one side wall of the main casing 2 for inserting and removing a process cartridge 20 described later, and a front cover 7 capable of opening and closing over the access opening 6. The front cover 7 is rotatably supported by a cover shaft 8 inserted through a bottom edge of the front cover 7. Accordingly, when the front cover 7 is rotated closed about the cover shaft 8, the front cover 7 covers the access opening 6, as shown in FIG. 1. When the front cover 7 is rotated open about the cover shaft 8, the access opening 6 is exposed, enabling the process cartridge 20 to be mounted into or removed from the main casing 2 via the access opening 6.

In the following description, the side of the laser printer 1 on which the front cover 7 is mounted and the corresponding side of the process cartridge 20 when the process cartridge 20 is mounted in the main casing 2 will be referred to as the "front side," while the opposite side will be referred to as the "rear side."

(2) Feeding Unit

The feeding unit 4 includes a paper tray 9 that can be inserted into or removed from a lower section of the main casing 2 in the front-to-rear direction, a separating roller 10 and a separating pad 11 disposed above a front end of the paper tray 9, and a feeding roller 12 disposed on the rear side of the separating roller 10 upstream of the separating pad 11 with respect to the conveying direction of the paper 3 (hereinafter referred to as the "paper-conveying direction"). The feeding unit 4 also includes a paper dust roller 13 disposed above and forward of the separating roller 10 and downstream of the separating roller 10 in the paper-conveying direction, and a pinch roller 14 disposed in opposition to the paper dust roller 13.

A paper-conveying path for the paper 3 on the feeding end reverses directions toward the rear side of the laser printer 1, forming a substantial U-shape near the paper dust roller 13. The feeding unit 4 also includes a pair of registration rollers 15 disposed below the process cartridge 20 farther downstream of the U-shaped portion of the paper-conveying path with respect to the paper-conveying direction.

A paper-pressing plate 16 is provided inside the paper tray 9 for supporting the paper 3 in a stacked state. The paper-pressing plate 16 is pivotably supported on the rear end thereof, so that the front end can pivot downward to a resting position in which the paper-pressing plate 16 rests on a bottom plate of the paper tray 9 and can pivot upward to a feeding position in which the paper-pressing plate 16 slopes upward from the rear end to the front end.

A lever 17 is provided in the front section of the paper tray 9 for lifting the front end of the paper-pressing plate 16 upward. The rear end of the lever 17 is pivotably supported on a lever shaft 18 at a position below the front end of the paper-pressing plate 16 so that the front end of the lever 17 can pivot between a level position in which the lever 17 lies along the bottom plate of the paper tray 9 and a sloped position in which the front end of the lever 17 lifts the paper-pressing plate 16 upward. When a driving force is inputted into the lever shaft 18, the lever 17 rotates about the lever shaft 18 and the front end of the lever 17 raises the front end of the paper-pressing plate 16, shifting the paper-pressing plate 16 into the feeding position.

When the paper-pressing plate 16 is in the feeding position, the topmost sheet of paper 3 stacked on the paper-pressing plate 16 is pressed against the feeding roller 12. The rotating feeding roller 12 begins feeding the sheets of paper 3 toward a separating position between the separating roller 10 and separating pad 11.

When the paper tray 9 is removed from the main casing 2, the paper-pressing plate 16 settles into the resting position. While the paper-pressing plate 16 is in the resting position, the paper 3 can be stacked on the paper-pressing plate 16.

When the feeding roller 12 conveys a sheet of the paper 3 toward the separating position and the sheet becomes interposed between the separating roller 10 and separating pad 11, the rotating separating roller 10 separates and feeds the paper 3 one sheet at a time. Each sheet of paper 3 fed by the separating roller 10 passes between the paper dust roller 13 and pinch roller 14. After the paper dust roller 13 removes paper dust from the sheet of paper 3, the sheet is conveyed along the U-shaped paper-conveying path on the feeding end, thereby reversing directions in the main casing 2, and is conveyed toward the registration rollers 15.

After registering the paper 3, the registration rollers 15 convey the paper 3 to a transfer position between a photosensitive drum 28 and a transfer roller 31 described later, at which position a toner image formed on the photosensitive drum 28 is transferred onto the paper 3.

(3) Image-Forming Unit

The image-forming unit 5 includes a scanning unit 19, the process cartridge 20, and a fixing unit 21.

(a) Scanning Unit

The scanning unit 19 is disposed in a top section of the main casing 2 and includes a laser light source (not shown), a polygon mirror 22 that can be driven to rotate, an fθ lens 23, a reflecting mirror 24, a lens 25, and a reflecting mirror 26. The laser light source emits a laser beam based on image data. As illustrated by a dotted line in FIG. 1, the laser beam is deflected by the polygon mirror 22, passes through the fθ lens 23, is reflected by the reflecting mirror 24, passes through the lens 25, and is reflected downward by the reflecting mirror 26 to be irradiated on the surface of the photosensitive drum 28 in the process cartridge 20.

(b) Process Cartridge

Figure 2A:
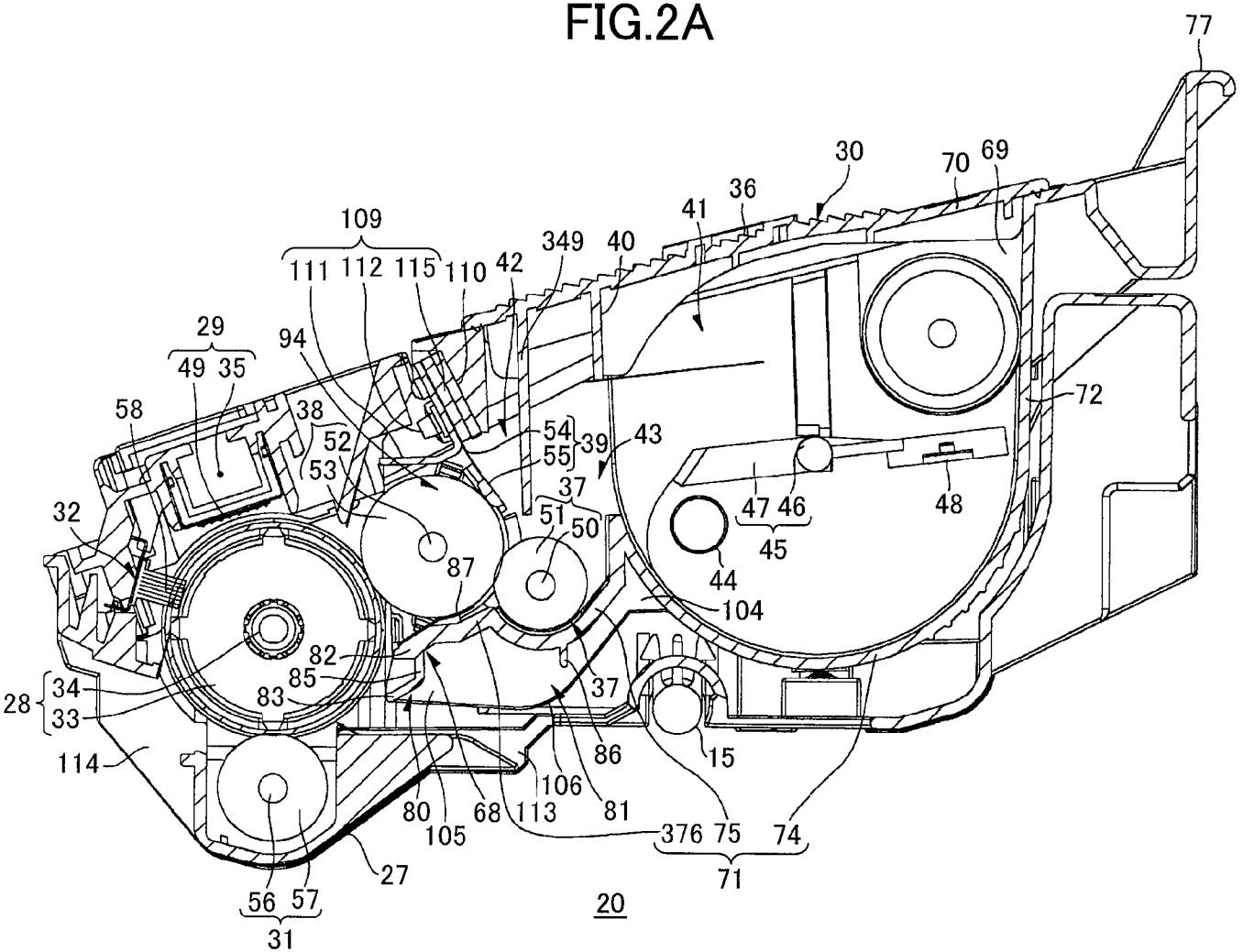
FIG. 2A is a side cross-sectional view of a process cartridge employed in the laser printer shown in FIG. 1.

As shown in FIG. 2A, the process cartridge 20 is provided in the main casing 2 beneath the scanning unit 19 and can be mounted in or removed from the main casing 2 through the access opening 6. The process cartridge 20 includes a drum cartridge 27 and a developer cartridge 30 detachably mounted on the drum cartridge 27.

The drum cartridge 27 includes a drum side casing 76 and, within the drum side casing 76, the photosensitive drum 28, a Scorotron charger 29, the transfer roller 31, and a cleaning member 32.

Within the drum cartridge 27 are formed a pre-drum opening 113 for conveying the paper 3 to the transfer position inside the drum cartridge 27, and a post-drum opening 114 for conveying the paper 3 from the transfer position back out of the drum cartridge 27. The pre-drum opening 113 is provided on the front side of the transfer position below the developer cartridge 30 to allow communication between areas inside and outside the drum cartridge 27 along an axial direction of the transfer roller 31 (hereinafter simply referred to as the "axial direction"). The post-drum opening 114 is formed on the rear side of the transfer position opposing the pre-drum opening 113 via the transfer position in order to provide communication between the inside and outside of the drum cartridge 27 along the axial direction.

The photosensitive drum 28 includes a main drum body 33 that is cylindrical in shape and has a positive charging photosensitive layer formed of polycarbonate or the like on its outer surface, and a metal drum shaft 34 extending through the center of the main drum body 33 along the axial direction thereof. The metal drum shaft 34 is supported in the drum cartridge 27, and the main drum body 33 is rotatably supported relative to the metal drum shaft 34. With this construction, the photosensitive drum 28 is disposed in the drum cartridge 27 and is capable of rotating about the metal drum shaft 34. Further, the photosensitive drum 28 is driven to rotate by a driving force inputted from a motor (not shown).

The charger 29 is supported on the drum cartridge 27 diagonally above and rearward of the photosensitive drum 28. The charger 29 opposes the photosensitive drum 28 but is separated a prescribed distance from the photosensitive drum 28 so as not to contact the same. The charger 29 includes a discharge wire 35 disposed in opposition to but separated a prescribed distance from the photosensitive drum 28, and a grid 49 provided between the discharge wire 35 and the photosensitive drum 28 for controlling the amount of corona discharge from the discharge wire 35 that reaches the photosensitive drum 28. By applying a high voltage to the discharge wire 35 for generating a corona discharge from the discharge wire 35 at the same time a bias voltage is applied to the grid 49, the charger 29 can charge the surface of the photosensitive drum 28 with a uniform positive polarity.

The developer cartridge 30 includes a casing 36 and, within the casing 36, a supply roller 37, a developing roller 38, and a thickness-regulating blade 39. The developer cartridge 30 is detachably mounted on the drum cartridge 27. Accordingly, when the process cartridge 20 is mounted in the main casing 2, the developer cartridge 30 can be mounted in the main casing 2 by first opening the front cover 7 and subsequently inserting the developer cartridge 30 through the access opening 6 and mounting the developer cartridge 30 on the process cartridge 20.

The casing 36 has a box shape that is open on the rear side, as will be described later, and has two side walls 69. A partitioning wall 40 is provided in the casing 36 for partitioning the interior of the casing 36 into a toner-accommodating chamber 41 and a developing chamber 42. The partitioning wall 40 is disposed at a position in the casing 36 midway in the front-to-rear direction for partitioning the interior of the casing 36 in the front-to-rear direction. An opening 43 is formed through a midway region of the partitioning wall 40.

The toner-accommodating chamber 41 occupies a space in the front side of the casing 36 partitioned by the partitioning wall 40. The toner-accommodating chamber 41 is filled with a nonmagnetic, single-component toner having a positive charge. The toner used in the illustrative example is a polymerized toner obtained by copolymerizing a polymerized monomer using a well-known polymerization method such as suspension polymerization. The polymerized monomer may be, for example, a styrene monomer such as styrene or an acrylic monomer such as acrylic acid, alkyl (C1-C4) acrylate, or alkyl (C1-C4) meta acrylate. The polymerized toner is formed as particles substantially spherical in shape in order to have excellent fluidity for achieving high-quality image formation.

This type of toner is compounded with a coloring agent, such as carbon black, or wax, as well as an additive such as silica to improve fluidity. The average diameter of the toner particles is about 6-10 μm.

Toner detection windows 44 are provided in both side walls 69 of the casing 36 that define the toner-accommodating chamber 41 for detecting the amount of toner remaining in the toner-accommodating chamber 41. The toner detection windows 44 are formed in the side walls 69 near the partitioning wall 40 and oppose each other in the width direction (the direction orthogonal to the front-to-rear direction and the vertical) across the toner-accommodating chamber 41. The toner detection windows 44 are formed by embedding a transparent disc-shaped plate in each side wall 69.

An agitator 45 is disposed in the toner-accommodating chamber 41 for agitating toner accommodated therein. The agitator 45 includes a rotational shaft 46 and an agitating member 47.

The rotational shaft 46 is rotatably supported in the side walls 69 substantially in the center of the toner-accommodating chamber 41. The agitating member 47 is provided on the rotational shaft 46. A motor (not shown) produces a driving force that is inputted into the rotational shaft 46 for driving the rotational shaft 46 to rotate. Consequently, the agitating member 47 moves in a circular path about the rotational shaft 46 through the toner-accommodating chamber 41 and stirs toner accommodated in the toner-accommodating chamber 41. When the agitating member 47 stirs the toner, some of the toner is discharged in the front-to-rear direction toward the supply roller 37 through the opening 43 formed in the partitioning plate 40.

The agitator 45 also includes wipers 48 attached at both axial ends of the rotational shaft 46. When the rotational shaft 46 rotates, the wipers 48 move in a circular direction about the rotational shaft 46 through the toner-accommodating chamber 41 in order to wipe the toner detection windows 44 provided in the side walls 69. Hence, the wipers 48 function to clean the toner detection windows 44.

The developing chamber 42 occupies an interior space in the rear side of the casing 36 partitioned by the partitioning wall 40. The developing chamber 42 accommodates the supply roller 37, the developing roller 38, and the thickness-regulating blade 39.

The supply roller 37 is disposed rearward of the opening 43 and includes a metal roller shaft 50 covered by a sponge roller 51 formed of an electrically conductive foam material. The roller shaft 50 is rotatably supported within the developing chamber 42 in both side walls 69 of the casing 36. The supply roller 37 is driven to rotate by a driving force inputted into the roller shaft 50 from a motor (not shown).

The developing roller 38 is disposed rearward of the supply roller 37 and contacts the supply roller 37 with pressure so that both are compressed. The developing roller 38 includes a metal roller shaft 52, and a rubber roller 53 formed of an electrically conductive rubber material that covers the roller shaft 52. The roller shaft 52 is rotatably supported in both side walls 69 within the developing chamber 42. The rubber roller 53 is more specifically formed of an electrically conductive urethane rubber or silicon rubber containing fine carbon particles, the surface of which is coated with urethane rubber or silicon rubber containing fluorine. The developing roller 38 is driven to rotate by a driving force inputted into the roller shaft 52 from a motor (not shown). Further, a developing bias is applied to the developing roller 38 during a developing operation.

When the developer cartridge 30 is mounted in the drum cartridge 27, the developing roller 38 opposes the photosensitive drum 28 diagonally from the top front thereof. In other words, the rear portion of the developing roller 38 below the vertical center that protrudes farthest rearward contacts the photosensitive drum 28.

The thickness-regulating blade 39 includes a main blade member 54 configured of a metal leaf spring, and a pressing part 55 provided on a distal end of the main blade member 54. The pressing part 55 has a semicircular cross section and is formed of an insulating silicon rubber. The thickness-regulating blade 39 is attached to the casing 36. Specifically, a mounting member 109 is provided for fixing a base end of the main blade member 54 to a rear end portion of the casing 36.

A sealing member 110 is interposed between the casing 36 and mounting member 109 to prevent toner from leaking therethrough.

The mounting member 109 is provided in the rear section of the casing 36 and includes a plate-shaped front support member 115, a back support member 111 having a substantially L-shaped cross section, and a screw 112. The front support member 115 is disposed on the rear side of the sealing member 110. The base end of the main blade member 54 is disposed on the rear side of the front support member 115, and the back support member 111 is disposed on the rear side of the base end of the main blade member 54. The screw 112 is inserted through the back support member 111, the base end of the main blade member 54, and the front support member 115 and fixes these components together. With the sealing member 110 interposed between the thickness-regulating blade 39 and casing 36, the thickness-regulating blade 39 is fixed together with the mounting member 109 to the casing 36 by a screw 130 (see FIGS. 3 and 4). Hence, the main blade member 54 is attached to the casing 36 with the base end of the main blade member 54 interposed between the front support member 115 and back support member 111. With this construction, the pressing part 55 disposed on the distal end of the main blade member 54 contacts the developing roller 38 with pressure through the elastic force of the main blade member 54.

Toner discharged through the opening 43 is supplied onto the developing roller 38 by the rotating supply roller 37. At this time, the toner is positively tribocharged between the supply roller 37 and the developing roller 38. As the developing roller 38 rotates, the toner supplied to the surface of the developing roller 38 passes between the rubber roller 53 of the developing roller 38 and the pressing part 55 of the thickness-regulating blade 39, thereby maintaining a uniform thickness of toner on the surface of the developing roller 38.

The cleaning member 32 includes a cleaning brush 58 that functions to scrape off paper dust and the like deposited on the photosensitive drum 28.

As the photosensitive drum 28 rotates, the charger 29 charges the surface of the photosensitive drum 28 with a uniform positive polarity. Subsequently, a laser beam emitted from the scanning unit 19 is scanned at a high speed over the surface of the photosensitive drum 28, forming an electrostatic latent image corresponding to an image to be formed on the paper 3.

Next, positively charged toner carried on the surface of the developing roller 38 comes into contact with the photosensitive drum 28 as the developing roller 38 rotates and is supplied to areas on the surface of the positively charged photosensitive drum 28 that were exposed to the laser beam and, therefore, have a lower potential. In this way, the latent image on the photosensitive drum 28 is transformed into a visible image according to a reverse developing process so that a toner image is carried on the surface of the photosensitive drum 28.

Subsequently, as the registration rollers 15 convey a sheet of the paper 3 into the drum cartridge 27 via the pre-drum opening 113 and through the transfer position between the photosensitive drum 28 and transfer roller 31, the toner image carried on the surface of the surface of the photosensitive drum 28 is transferred onto the paper 3 by the transfer bias applied to the transfer roller 31. After the toner image is transferred, the paper 3 is conveyed out of the drum cartridge 27 via the post-drum opening 114 and is conveyed to the fixing unit 21.

Toner remaining on the photosensitive drum 28 after the transfer operation is recovered by the developing roller 38. Further, paper dust deposited on the photosensitive drum 28 from the paper 3 is recovered by the cleaning brush 58 of the cleaning member 32.

(c) Fixing Unit

The fixing unit 21 is disposed on the rear side of the process cartridge 20 and includes a fixed frame 59; and a heating roller 60 and a pressure roller 61 provided within the fixed frame 59.

The heating roller 60 includes a metal tube, the surface of which has been coated with a fluorine resin, and a halogen lamp disposed inside the metal tube for heating the same. The heating roller 60 is driven to rotate by a driving force inputted from a motor (not shown).

The pressure roller 61 is disposed below and in opposition to the heating roller 60 and contacts the heating roller 60 with pressure. The pressure roller 61 is configured of a metal roller shaft covered with a roller that is formed of a rubber material. The pressure roller 61 follows the rotational drive of the heating roller 60.

In the fixing unit 21, a toner image transferred onto the paper 3 at the transfer position is fixed to the paper 3 by heat as the paper 3 passes between the heating roller 60 and pressure roller 61. After the toner image is fixed to the paper 3, the heating roller 60 and pressure roller 61 continue to convey the paper 3 along a discharge end paper-conveying path toward a discharge tray 62 formed on the top surface of the main casing 2.

The paper-conveying path on the discharge end leads from the fixing unit 21 to the discharge tray 62 and is substantially U-shaped for reversing the conveying direction of the paper 3 to a direction toward the front of the laser printer 1. A pair of conveying rollers 63 is disposed at a midpoint along the discharge end paper-conveying path, and a pair of discharge rollers 64 is disposed at a downstream end of the same path.

Hence, after passing through the fixing unit 21, the paper 3 is conveyed along the discharge end paper-conveying path, where the conveying rollers 63 receive and convey the paper 3 to the discharge rollers 64, and the discharge rollers 64 subsequently receive and discharge the paper 3 onto the discharge tray 62.

Next, a structure related to the casing of the developer cartridge will be described.

Figure 3:
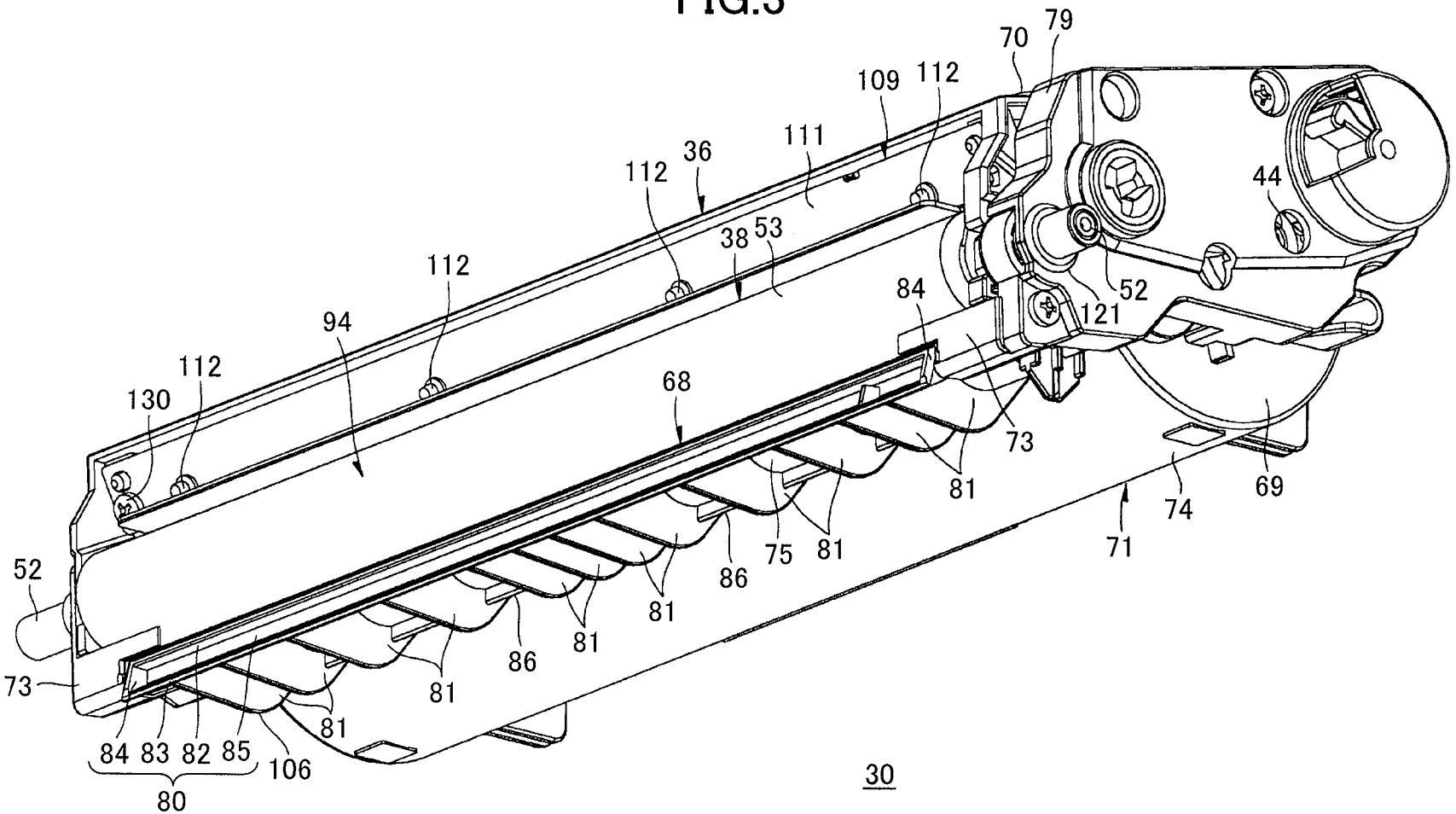
FIG. 3 is a rear side perspective view of a developer cartridge according to the invention.
Figure 4:
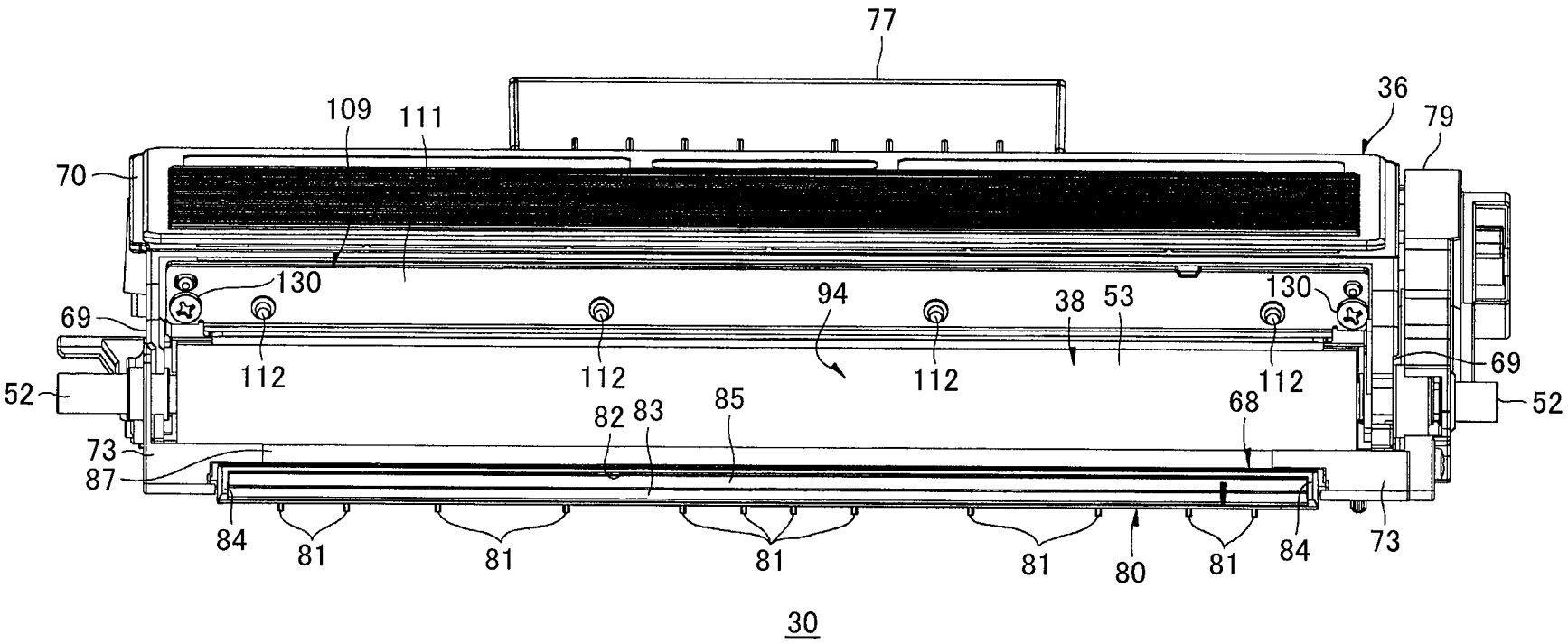
FIG. 4 is a rear view of the developer cartridge.

As shown in FIGS. 2A and 3, the casing 36 of the developer cartridge 30 has a box shape that is open on the rear side and is integrally provided with a top wall 70, a front wall 72, the two side walls 69 described above, and a bottom wall 71. The open region on the rear side is an opening 94.

Figure 5:
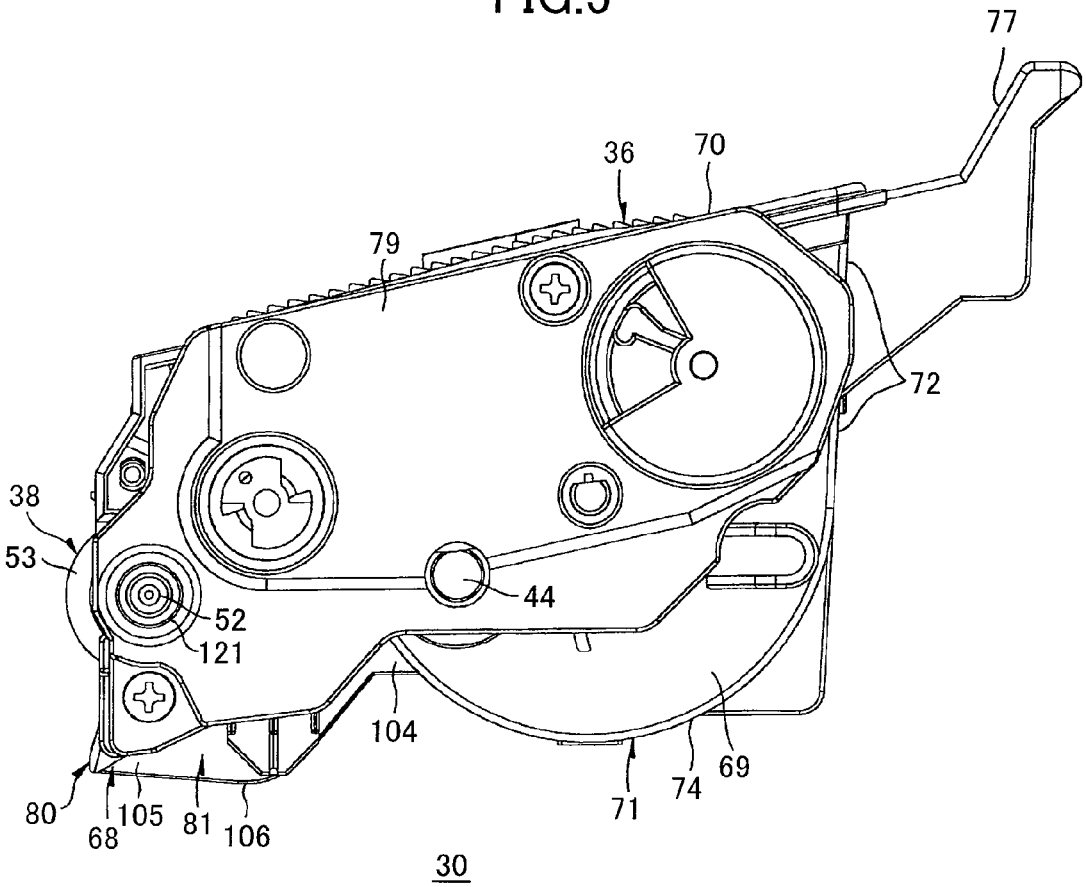
FIG. 5 is a side view of the developer cartridge.

As shown in FIG. 3, the opening 94 is defined by the back support member 111 of the mounting member 109, the rear edges of the side walls 69, and the rear edge of the bottom wall 71. When viewed from the rear side, the opening 94 is substantially rectangular and extends in the width direction. The developing roller 38 is disposed in the opening 94 and is exposed therefrom. As shown in FIG. 5, the developing roller 38 is supported on the casing 36 so as to protrude out of the casing 36 via the opening 94 when viewed from the side. An insertion hole 121 is formed in the rear end of each side wall 69 of the casing 36 at positions opposing each other in the width direction. The roller shaft 52 of the developing roller 38 is inserted through the insertion holes 121 so that the developing roller 38 is rotatably supported on the casing 36 with a vertical center portion of the rubber roller 53 protruding farthest out of the casing 36 through the opening 94.

As shown in FIG. 2A, the top wall 70 is plate-shaped in a plan view and functions to close off the top of the toner-accommodating chamber 41 and developing chamber 42.

The front wall 72 is plate-shaped in a front view and functions to close off the front side of the toner-accommodating chamber 41. The front wall 72 extends downward from the front edge of the top wall 70.

As shown in FIGS. 3 and 5, the side walls 69 are plate-shaped and function to close off the sides of the toner-accommodating chamber 41 and developing chamber 42. The side walls 69 also rotatably support the rotational shaft 46, roller shaft 50, and roller shaft 52.

As shown in FIG. 2A, the bottom wall 71 functions to close off the bottom of the toner-accommodating chamber 41 and developing chamber 42. The bottom wall 71 is integrally provided with a front bottom wall 74, a center bottom wall 75, and a rear bottom wall 376.

The front bottom wall 74 has a substantially semicircular cross section following the rotational path of the agitator 45 in the toner-accommodating chamber 41. The center bottom wall 75 is provided on the rear side of the front bottom wall 74 and has a substantially semicircular cross section that follows the peripheral surface of the supply roller 37 in the developing chamber 42.

The rear bottom wall 376 is provided on the rear side of the center bottom wall 75 and has a flanged plate shape that slopes downward to the rear. The rear edge of the rear bottom wall 376 is a lower edge 68 that forms the lower edge of the opening 94 extending in the width direction of the casing 36.

A handle 77 is provided on the front side of the casing 36 for the user to grip when mounting or removing the developer cartridge 30 and process cartridge 20. The handle 77 protrudes forward from the top of the front wall 72 constituting the casing 36.

As shown in FIG. 3, a gear mechanism (not shown) for driving the rotational shaft 46, roller shaft 50, and roller shaft 52 to rotate, and a gear cover 79 for covering the gear mechanism are provided on one of the side walls 69 constituting the casing 36. Two partial rear walls 73 are provided on the lower edge 68 in the opening 94 of the casing 36.

The partial rear walls 73 are disposed at the widthwise ends of the lower edge 68 and are spaced apart in the width direction. The partial rear walls 73 extend upward from both widthwise ends of the lower edge 68. A bottom portion of each partial rear walls 73 on the widthwise inner side has been cut away to form a substantial L-shape in a rear view.

A reinforcing part 80 is provided on the lower edge 68 of the opening 94.

The reinforcing part 80 extends along the lower edge 68 between the two partial rear walls 73 and is fitted in the cutout portions of the partial rear walls 73. The reinforcing part 80 is formed continuously from the lower edge 68 of the opening 94 and is integrally provided with a top wall 82, a front wall 85, a bottom wall 83, and two side walls 84. The reinforcing part 80 is box-shaped and open on the rear side. Specifically, a cross section of the reinforcing part 80 taken orthogonal to the width direction substantially forms three sides of a rectangle with the missing side on the rear.

Figure 7:
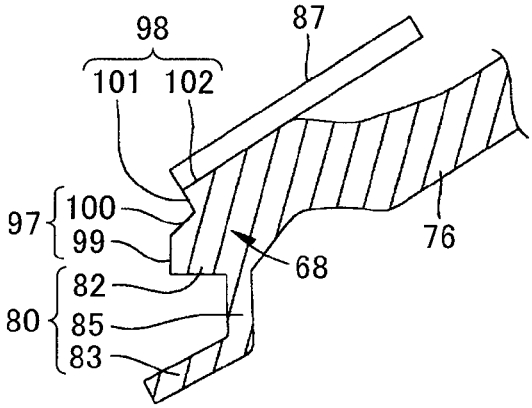
FIG. 7 is an enlarged side cross-sectional view showing a lower edge of an opening formed in the casing of the developer cartridge.

As shown in FIGS. 3 and 7, the top wall 82 is provided along the lower edge 68 and formed continuously therewith. The top wall 82 protrudes rearward. The front wall 85 is shaped substantially like an elongated rectangular plate along the lower edge 68 and extends downward from the front edge of the top wall 82. The bottom wall 83 also has a substantially elongated rectangular plate shape extending along the lower edge 68 and is disposed opposite the top wall 82 in the vertical direction. The bottom wall 83 extends obliquely downward and rearward from the lower edge of the front wall 85.

As shown in FIG. 3, the side walls 84 have a substantially rectangular plate shape and are disposed on both widthwise ends of the top wall 82, front wall 85, and bottom wall 83 so as to face each other in the width direction.

As shown in FIG. 7, with the front wall 85 linking the front ends of the top wall 82 and bottom wall 83, a cross section of the reinforcing part 80 taken orthogonal to the width direction forms three sides of a rectangle that opens toward the rear. Further, as shown in FIG. 3, the two side walls 84 connect both widthwise edges of the top wall 82 to the respective widthwise edges of the front wall 85 and bottom wall 83, forming a box shape that opens toward the rear.

As shown in FIG. 7, the portion of the lower edge 68 above the reinforcing part 80 is integrally provided with a rear step part 97 and a front step part 98 disposed diagonally above and forward of the rear step part 97. With this structure, a cross section of the lower edge 68 taken orthogonal to the width direction has a stepped formation.

The rear step part 97 includes a rear surface 99 and a top surface 100. The rear surface 99 forms the endface on the rear side of the top wall 82. The rear surface 99 is a flat vertical surface in a cross section taken orthogonal to the width direction. The top surface 100 is provided continuously from the top of the rear surface 99. In a cross section taken orthogonal to the width direction, the top surface 100 has a flat plate shape extending diagonally upward and forward from the rear surface 99.

The front step part 98 includes a rear surface 101, and a top surface 102. The rear surface 101 is formed continuously from the front edge of the top surface 100. In a cross section taken orthogonal to the width direction, the rear surface 101 is plate-shaped and extends diagonally upward and rearward from the front edge of the top surface 100.

The top surface 102 is formed continuously from the top edge of the rear surface 101. In a cross section taken orthogonal to the width direction, the top surface 102 has a plate shape that extends diagonally upward and forward from the top edge of the rear surface 101.

A lower film 87 is provided on the top surface 102 of the lower edge 68. The lower film 87 is formed of a polyethylene terephthalate film in the shape of a substantially rectangular sheet. As shown in FIGS. 2 and 7, the rear half of the lower film 87 is fixed to the surface of the top surface 102.

Specifically, the lower film 87 is disposed so that the rear edge of the lower film 87 is flush with the rear surface 101 of the lower edge 68, as shown in FIG. 7. More specifically, using the rear edge of the top surface 102 (the edge formed by the rear surface 101 and top surface 102) as a reference for the front-to-rear direction, the rear half of the lower film 87 is fixed to the top surface 102 with double-sided tape or the like (not shown). As a result, the rear endface of the lower film 87 is positioned flush with the reference in the front-to-rear direction.

As shown in FIG. 2A, the lower film 87 is positioned with the rear half fixed to the top surface 102 and the front half extending obliquely upward and forward to contact the lower surface of the developing roller 38. In this way, the lower film 87 blocks off the gap between the lower edge 68 and the developing roller 38 and prevents toner from leaking through that gap.

Figure 6:
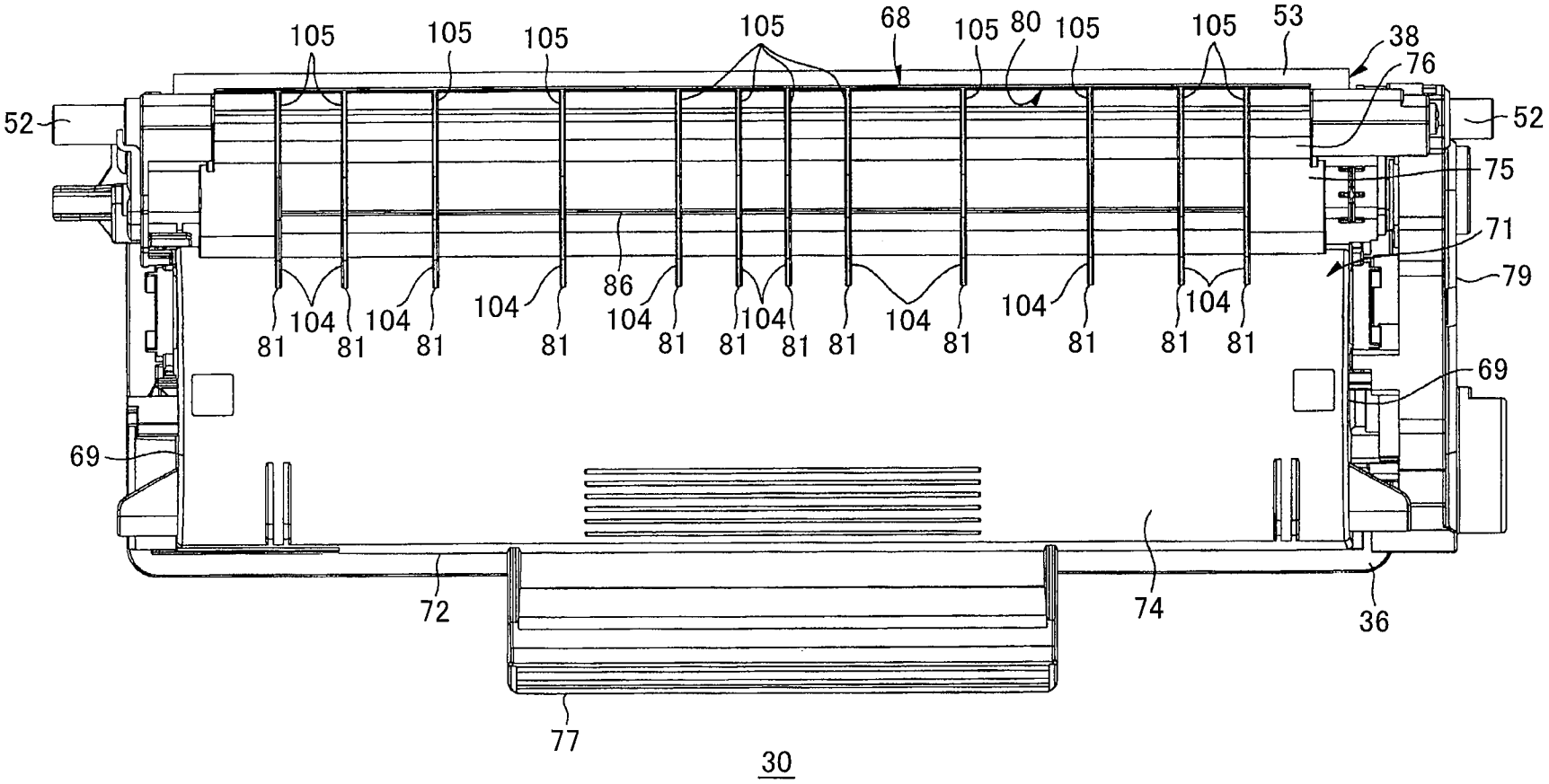
FIG. 6 is a bottom view of the developer cartridge.

As shown in FIGS. 3 and 6, guide members 81 are provided on the casing 36 of the developer cartridge 30. The guide members 81 protrude downward from the bottom wall 71 and are plate-shaped, extending in the front-to-rear direction. The guide members 81 are disposed parallel to each other at intervals in the width direction. As shown in FIG. 2A, each guide member 81 protrudes downward from the rear bottom wall 376 and center bottom wall 75 and has a rear end 105 connected to the front wall 85 and bottom wall 83, and a front end 104 connected to the front bottom wall 74. Each guide member 81 is integrally formed with the bottom wall 83, front wall 85, rear bottom wall 376, center bottom wall 75, and front bottom wall 74. Each guide member 81 also has a lower edge 106 that extends straight forward from the rear end of the bottom wall 83 and then gently curves upward and forward below the center bottom wall 75 to meet the rear end of the front bottom wall 74.

As shown in FIG. 3, a guide member reinforcing part 86 is provided for reinforcing the guide members 81. As shown in FIGS. 2A and 6, the guide member reinforcing part 86 has a plate shape and extends in the width direction. The guide member reinforcing part 86 protrudes downward from the center bottom wall 75 so as to intersect a front-to-rear midpoint of each guide member 81 in a direction substantially orthogonal to the front-to-rear direction. The guide member reinforcing part 86 couples the guide members 81 in the width direction and reinforces the guide members 81.

In the developer cartridge 30 of the above-described illustrative example, the box-shaped reinforcing part 80 open on the rear is provided along the lower edge 68 of the opening 94. The reinforcing part 80 effectively reinforces the lower edge 68 of the opening 94, which is a weak region of the casing 36. By forming the reinforcing part 80 in a box shape open toward the rear side, it is possible to form the casing 36 at a uniform thickness in the region of the reinforcing part 80 and in the regions other than the reinforcing part 80 to reduce the likelihood of sinks developing during molding in the surface opposing the developing roller 38 that is formed continuously with the reinforcing part 80, that is, the top surface 102 of the lower edge 68. Hence, the reinforcing part 80 can reliably reinforce the opening 94 of the casing 36 and, moreover, can maintain a precise gap between the developing roller 38 and the lower edge 68 of the opening 94.

In the developer cartridge 30 of the illustrative example described above, the cross section of the reinforcing part 80 taken orthogonal to the width direction has a three-sided rectangular shape, facilitating removal of the reinforcing part 80 during the molding process and enabling the reinforcing part 80 to be easily formed in a box shape. Hence, it is possible to reliably reinforce the opening 94 of the casing 36, while simplifying the molding process.

In the developer cartridge 30 of the illustrative example, the reinforcing part 80 extends in the width direction of the developing roller 38, that is, along the width direction of the casing 36 in the lower edge 68 of the opening 94. The reinforcing part 80 prevents the casing 36 from deforming when the user grips the casing 36 near the opening 94, thereby effectively preventing damage to the developing roller 38 and the occurrence of toner leaking between the developing roller 38 and casing 36.

The lower film 87 in the developer cartridge 30 of the illustrative example blocks off the gap formed between the lower edge 68 of the opening 94 and the developing roller 38, preventing toner from leaking through this gap. Further, the reinforcing part 80 provided on the lower edge 68 is formed in a box shape that makes sinks less likely to occur during molding in the top surface 102 of the lower edge 68 that opposes the developing roller 38. As a result, the top surface 102 can be formed as a smooth surface, enabling the lower film 87 to be fixed to the smooth top surface 102 with precision.

Figure 8:
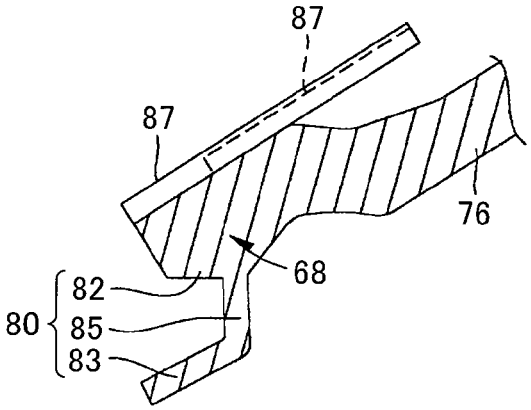
FIG. 8 is an enlarged side cross-sectional view showing the lower edge of the opening formed in the casing of a conventional developer cartridge.

When the lower edge 68 is formed with a simple rectangular cross section, as in the conventional structure shown in FIG. 8, if the lower film 87 is fixed to the lower edge 68 by aligning the rear edge of the lower film 87 with the rear edge of the lower edge 68, as shown by the solid line in FIG. 8, the lower film 87 is susceptible to peeling off the lower edge 68 should the lower edge 68 contact another component. On the other hand, if the lower film 87 is fixed to a position on the lower edge 68 farther forward than the rear edge, as indicated by the dotted line in FIG. 8, it is possible to reduce the risk of the lower film 87 peeling from the top surface of the lower edge 68, but there is no definite reference point for fixing the lower film 87 to the lower edge 68. As a result, it is not possible to fix the lower film 87 reliably to the lower edge 68 along the width direction, reducing the mounting precision of the lower film 87.

However, in the developer cartridge 30 of the illustrative example, the lower edge 68 has a stepped cross-sectional shape configured of the rear step part 97 and front step part 98. The lower film 87 is fixed to the lower edge 68 by aligning the rear edge of the lower film 87 with the rear edge of the front step part 98 provided farther forward of the rear step part 97, that is, on the upstream side in the direction that toner leaks through the opening 94. Therefore, if the rear step part 97 contacts another component, the lower film 87 is less likely to peel of the top surface 102 since the lower film 87 is fixed to the front step part 98 disposed in front of the rear step part 97. Moreover, fixing the lower film 87 on the front step part 98 with the rear edge of the front step part 98 as a reference point enables the lower film 87 to be fixed reliably along the top surface 102.

In the developer cartridge 30 of the illustrative example, the developing roller 38 protrudes out of the casing 36 via the opening 94. Accordingly, when the developer cartridge 30 is mounted on the drum cartridge 27, the developing roller 38 can oppose the photosensitive drum 28 from a position on the top front side so that a portion of the developing roller 38 below the vertical center protruding farthest through the opening 94 contacts the photosensitive drum 28. This construction can enhance the freedom of setting the device layout, enabling production of a more compact device. The construction can also allocate space for forming the reinforcing part 80 on the lower edge 68.

In the developer cartridge 30 of the illustrative example, the guide members 81 are formed continuously with the reinforcing part 80 for guiding the paper 3 to the transfer position between the photosensitive drum 28 and transfer roller 31 when the paper 3 is conveyed into the drum cartridge 27 through the pre-drum opening 113. Accordingly, the guide members 81 can smoothly guide the paper 3 to the transfer position, while further reinforcing the opening 94 of the casing 36.

Further, the guide members 81 are formed along the front-to-rear direction orthogonal to the width direction in which the reinforcing part 80 extends. The guide members 81 are spaced at intervals in the width direction. Accordingly, the guide members 81 can reliably guide the paper 3 to the transfer position while reducing the frictional resistance generated between the paper 3 and the guide members 81.

The process cartridge 20 and the laser printer 1 of the illustrative example described above includes the developer cartridge 30 provided with the reinforcing part 80 for reinforcing the opening 94 formed in the casing 36. Accordingly, the developer cartridge 30 enhances the rigidity of both the process cartridge 20 and the laser printer 1.

In the illustrative example described above, the developer cartridge 30 is detachably mounted on the drum cartridge 27 to form the process cartridge 20, and the process cartridge 20 is detachably mounted in the main casing 2. However, it is also possible to provide the photosensitive drum 28, charger 29, transfer roller 31, cleaning member 32, and the like in the main casing 2, while eliminating the drum cartridge 27, and to detachably mount the developer cartridge 30 in the main casing 2.

Figure 9:
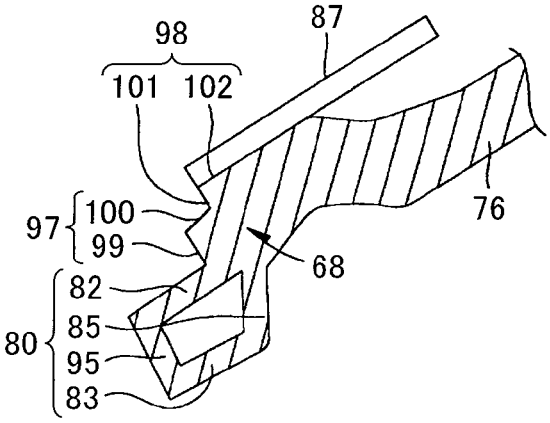
FIG. 9 is an enlarged side cross-sectional view showing the lower edge of the opening formed in the casing of FIG. 7 according to a variation of the illustrative example.

In the illustrative example described above, the cross section of the reinforcing part 80 taken orthogonal to the width direction forms three sides of a rectangle that is open toward the rear, as shown in FIG. 7. However, the reinforcing part of the invention need not have this cross-sectional shape, provided that the reinforcing part has a box shape. For example, the rear edges of the top wall 82, bottom wall 83, and side walls 84 (not shown in FIG. 9) may be connected by a rear wall 95, as shown in FIG. 9. With this construction, the cross section of the reinforcing part taken orthogonal to the width direction is a closed, hollow rectangle.

Figure 10:
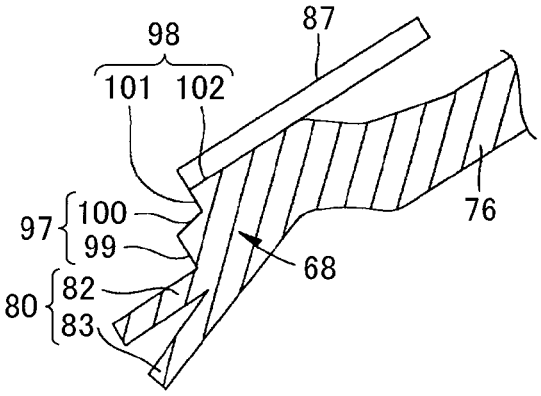
FIG. 10 is an enlarged side cross-sectional view showing the lower edge of the opening formed in the casing of FIG. 7 according to another variation of the illustrative example.

Alternatively, the reinforcing part 80 may be formed by connecting the front edges of the top wall 82 and bottom wall 83, as shown in FIG. 10, so that the cross section of the reinforcing part taken orthogonal to the width direction forms a V-shape that opens rearward.

As shown in FIG. 1, the developer cartridge 30 is detachably mounted in the drum side casing 76. Accordingly, when the process cartridge 20 is mounted in the main casing 2, the developer cartridge 30 can be mounted in the main casing 2 by first opening the front cover 7 and subsequently inserting the developer cartridge 30 through the access opening 6 and mounting the developer cartridge 30 on the process cartridge 20.

Figure 11:
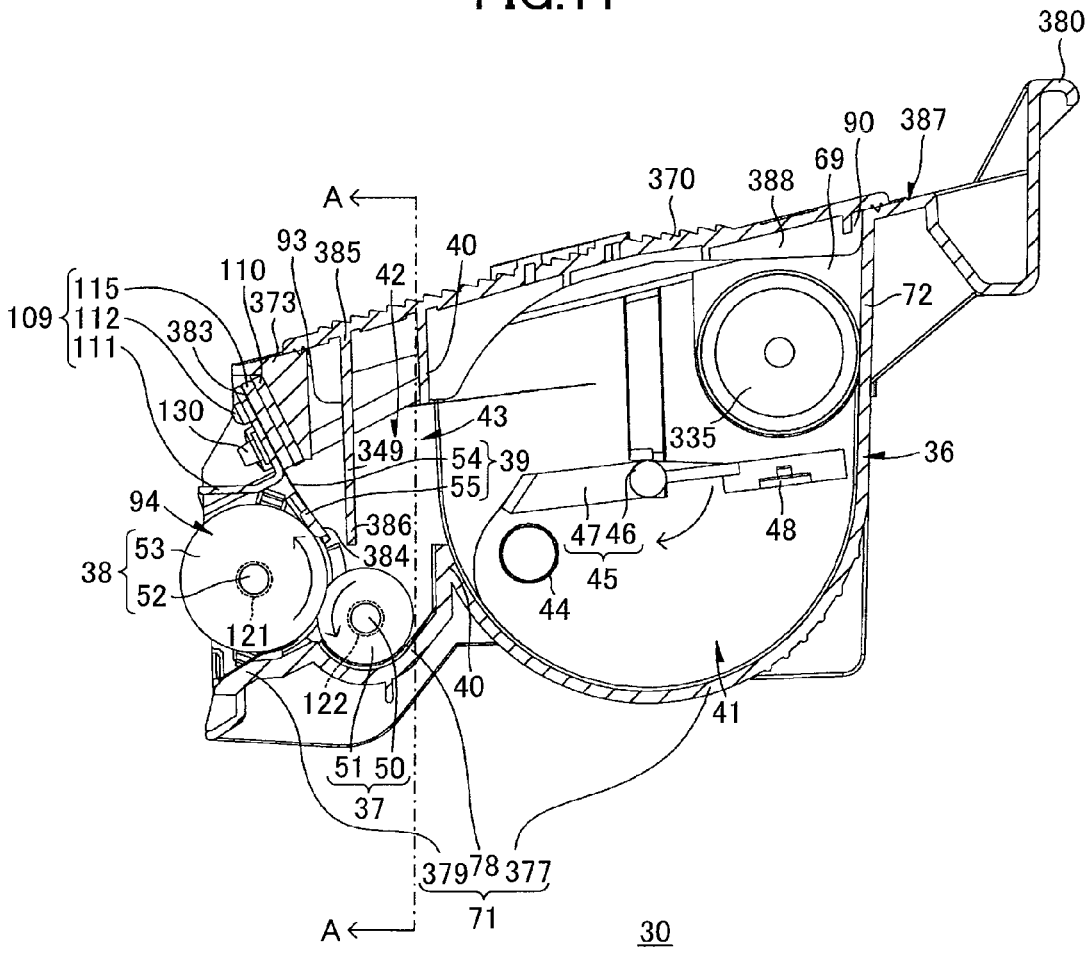
FIG. 11 is a side cross-sectional view of a developing chamber employed in the laser printer of FIG. 1.

As shown in FIG. 11, the developer cartridge 30 includes a developer side casing 36 and, within the developer side casing 36, a developing roller 38, a supply roller 37, a thickness-regulating blade 39, and a plate wall 349.

Figure 14:
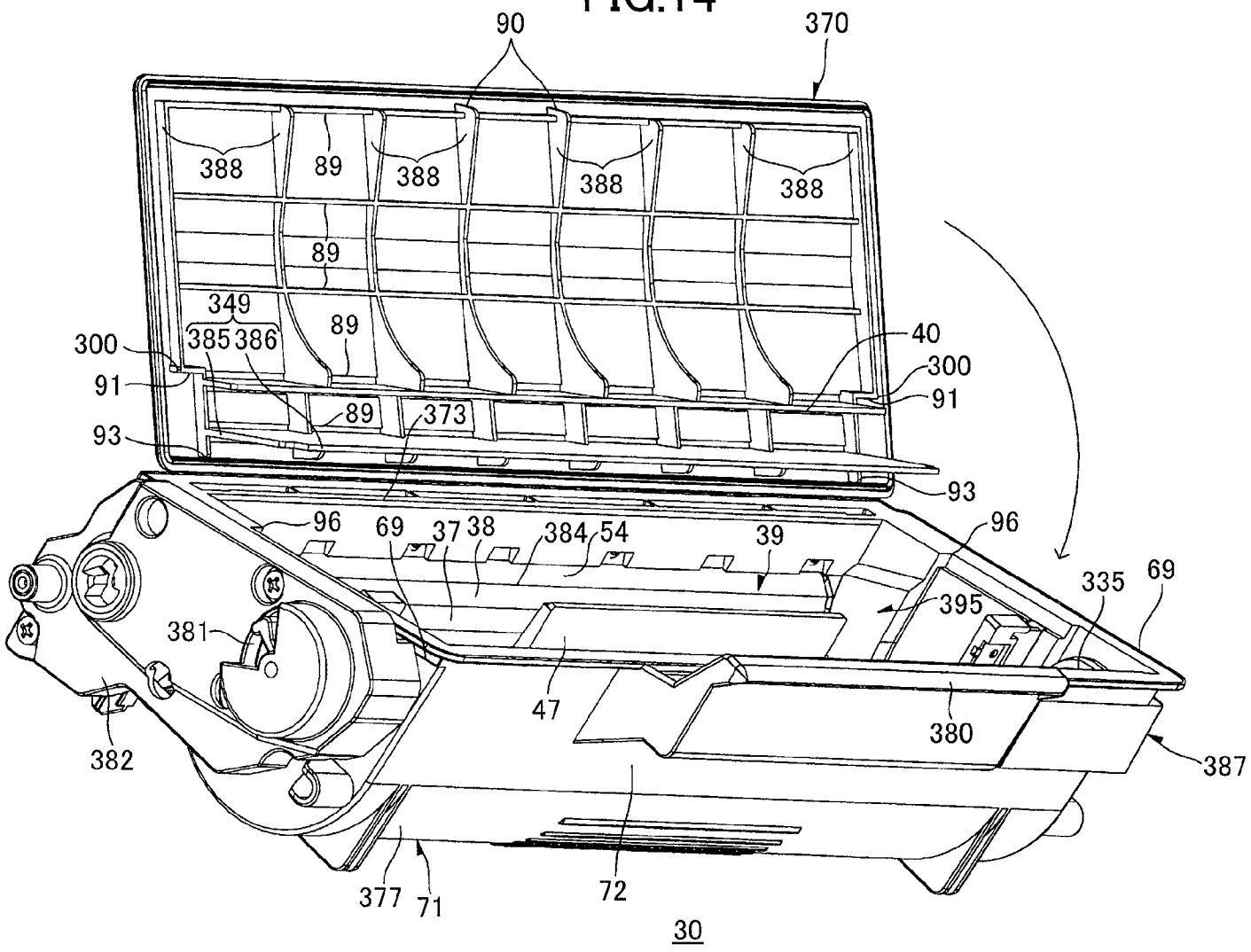
FIG. 14 is a perspective view from the front of the developer cartridge in FIG. 11 with a top cover in an open state.
Figure 15:
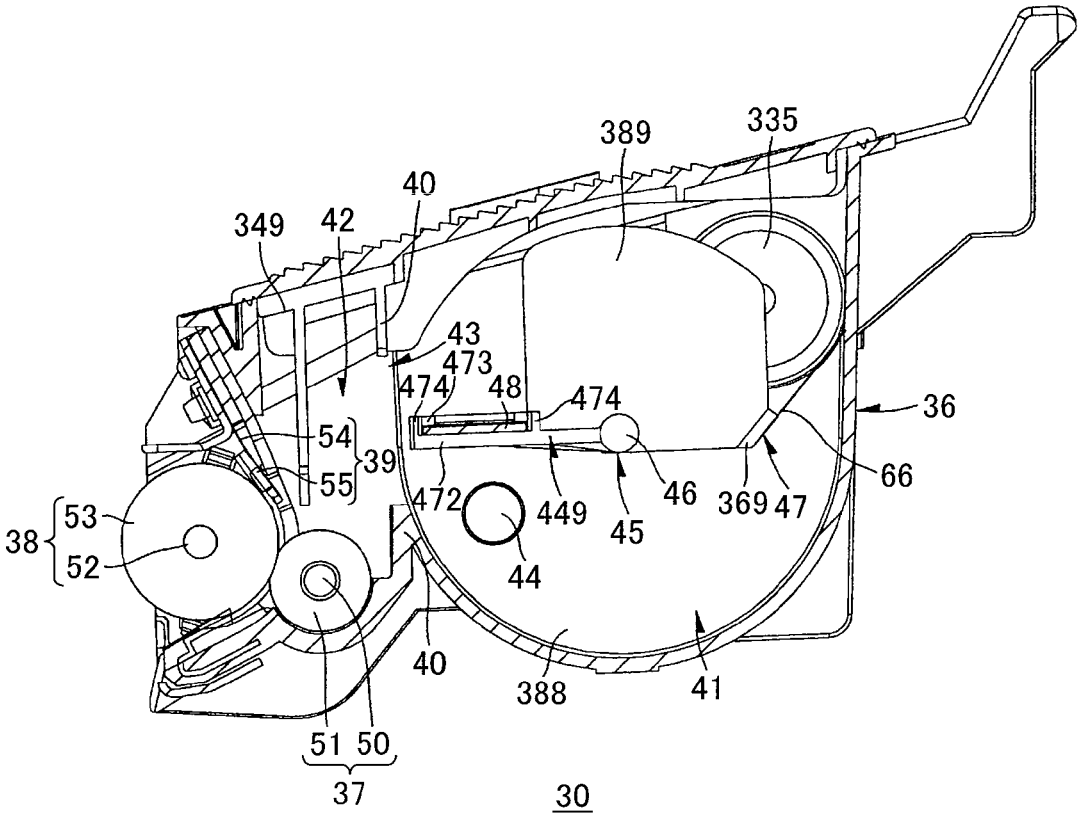
FIG. 15 is a side cross-sectional view of a developer cartridge employed in the laser printer of FIG. 1.

As shown in FIGS. 11 and 14, the developer side casing 36 is formed in a box shape that is open on the rear side. The developer side casing 36 includes a top cover 370, and a main casing body 387. An open portion formed on the rear side is a rear opening 94.

The rear opening 94 is defined by a back support member 111 of a mounting member 109 described later, and rear edges of side walls 69 and a bottom wall 71. The rear opening 94 is substantially rectangular in a rear view and extends in the width direction (hereinafter, the width direction will signify a direction orthogonal to the front-to-rear direction and the vertical direction).

The top cover 370 is plate-shaped in a plan view and opens and closes over the top of a toner-accommodating chamber 41 and a developing chamber 42 described later. The top cover 370 is integrally formed with an upper portion of a partitioning wall 40 described later, the plate wall 349, and a plurality of front-to-rear ribs 88 and widthwise ribs 89 described later.

The front-to-rear ribs 88 are plate-shaped and parallel to one another, extending in the front-to-rear direction on the top cover 370 when the top cover 370 is assembled on the main casing body 387 (see FIG. 11). As shown in FIG. 14, the front-to-rear ribs 88 are arranged parallel to one another at intervals in the width direction on the lower surface of the top cover 370 opposing the interior of the developer side casing 36. Forward protruding parts 90 are disposed on front ends of two of the front-to-rear ribs 88 that are disposed nearest the widthwise center of the top cover 370 for approaching the front edge of the top cover 370.

Two of the front-to-rear ribs 88 nearest the widthwise ends of the top cover 370 are also provided with step parts 91 midway in the front-to-rear direction. Rearward protruding parts 93 approaching the rear edge of the top cover 370 are provided on the rear end of these step parts 91, forming a narrow stepped configuration along the front-to-rear direction. Further, laterally protruding parts 300 are formed on the front-to-rear ribs 88 nearest the widthwise edges of the top cover 370 protruding outward in the width direction from the narrow stepped configuration.

The widthwise ribs 89 are plate-shaped and parallel to one another, extending in the width direction on the top cover 370 when the top cover 370 is assembled onto the main casing body 387 (see FIG. 11). As shown in FIG. 14, the parallel widthwise ribs 89 are arranged at intervals in the front-to-rear direction on the lower surface of the top cover 370 facing the interior of the developer side casing 36 so as to intersect the front-to-rear ribs 88.

The main casing body 387 is integrally provided with a front wall 72, the two side walls 69, the bottom wall 71, and a blade-mounting part 373. A top opening 395 that the top cover 370 covers is formed in the top of the main casing body 387.

The front wall 72 is plate-shaped in a front view and functions to close off the front side of the toner-accommodating chamber 41. As shown in FIG. 11, the front wall 72 extends downward from the front edge of the top cover 370.

The side walls 69 are plate-shaped and function to close off the sides of the toner-accommodating chamber 41 and developing chamber 42. The side walls 69 also rotatably support an agitator rotational shaft 46, a supply roller shaft 50, and a developing roller shaft 52 described later.

The bottom wall 71 functions to close off the bottom of the toner-accommodating chamber 41 and developing chamber 42. The bottom wall 71 is integrally provided with a front bottom wall 377, a center bottom wall 78, and a rear bottom wall 379.

The front bottom wall 377 has a substantially semicircular cross section following the rotational path of an agitator 45 described later in the toner-accommodating chamber 41.

The center bottom wall 78 is provided on the rear side of the front bottom wall 377 and has a substantially semicircular cross section that follows the peripheral surface of the supply roller 37 in the developing chamber 42.

The rear bottom wall 379 is provided on the rear side of the front bottom wall 377 and has a flanged plate shape that slopes downward to the rear.

The blade-mounting part 373 extends in the width direction, spanning between upper rear edges of the side walls 69. The blade-mounting part 373 has a triangular cross section that narrows toward the bottom. The rear face of the blade-mounting part 373 slopes downward and forward.

When viewed from the top, the top opening 395 is shaped similar to the outer edges of a lattice formed by the intersecting front-to-rear ribs 88 and widthwise ribs 89 on the top cover 370 so as to fit over these outer edges. Step parts 96 are formed on both side walls 69 constituting the sides of the top opening 395 for fitting loosely with the step parts 91 of the two front-to-rear ribs 88 nearest the outer widthwise edges of the top cover 373 when the top cover 370 is assembled on the main casing body 387.

As shown in FIGS. 11 and 14, hook parts formed by the rear edge of the top cover 370 and each of the rearward protruding parts 93 can engage with edges of the blade-mounting part 373 on the widthwise ends formed of the top surface and front surface of the blade-mounting part 373 and having an L-shaped cross section to position the rear edge of the top cover 370 relative to the rear edge of the main casing body 387 when assembled. The top cover 370 is then rotated in the direction of the arrow in FIG. 14 about the points of engagement between the hook parts and the edge of the blade-mounting part 373 until the outer edges of the lattice formed by the intersecting front-to-rear ribs 88 and widthwise ribs 89 are fitted into the top opening 395 formed in the main casing body 387, thereby completing the process of assembling the top cover 370 on the main casing body 387.

By placing the rearward protruding parts 93 in contact with the blade-mounting part 373 during this assembly process, the top cover 370 can be positioned relative to the main casing body 387 on the rear edge. Further, the top cover 370 can be positioned relative to the main casing body 387 in the width direction when the laterally protruding parts 300 provided on the outermost front-to-rear ribs 88 in the width direction contact the inner surfaces of the side walls 69 constituting the main casing body 387. The forward protruding parts 90 provided on front edges of the two centermost front-to-rear ribs 88 then contact the inner surface of the front wall 72 constituting the main casing body 387 to position the top cover 370 relative to the main casing body 387 on the front side. As a result, the top cover 370 can be assembled on the main casing body 387 with no play between the two.

A handle 380 is provided on the front side of the developer side casing 36 for the user to grip when mounting or removing the developer cartridge 30 and process cartridge 20. The handle 380 protrudes forward from the top of the front wall 72 constituting the developer side casing 36.

A gear mechanism 381 for driving the agitator rotational shaft 46, supply roller shaft 50, and developing roller shaft 52 to rotate, and a gear cover 382 for covering the gear mechanism 381 are provided on one of the side walls 69 constituting the developer side casing 36.

The partitioning wall 40 is provided in the developer side casing 36 for partitioning the interior of the developer side casing 36 into the toner-accommodating chamber 41 and the developing chamber 42.

The partitioning wall 40 is disposed at a position in the developer side casing 36 midway in the front-to-rear direction for partitioning the interior of the developer side casing 36 in the front-to-rear direction. An opening 43 penetrates a midway region of the partitioning wall 40 to allow communication between the toner-accommodating chamber 41 and developing chamber 42. The lower portion of the partitioning wall 40 is formed from the connecting parts of the front bottom wall 377 and center bottom wall 78. The upper portion of the partitioning wall 40 is formed on the top cover 370 in the width direction so as to oppose the lower portion of the partitioning wall 40 vertically with the opening 43 formed therebetween. The partitioning wall 40 extends vertically downward from the top cover 70 with a base end of the partitioning wall 40 connected to the top cover 370 at a position in the front-to-rear direction of the top cover 370 substantially equivalent to the step parts 91.

As shown in FIG. 11, the toner-accommodating chamber 41 occupies a space in the front side of the casing 36 partitioned by the partitioning wall 40. The toner-accommodating chamber 41 is filled with a nonmagnetic, single-component toner having a positive charge.

Toner supply openings for filling the toner-accommodating chamber 41 with toner are formed in both side walls 69 of the developer side casing 36 that define the toner-accommodating chamber 41. The toner supply openings are sealed with caps 335.

Toner detection windows 44 are provided in both side walls 69 of the casing 36 that define the toner-accommodating chamber 41 for detecting the amount of toner remaining in the toner-accommodating chamber 41. The toner detection windows 44 are formed in the side walls 69 near the partitioning wall 40 and oppose each other in the width direction across the toner-accommodating chamber 41. The toner detection windows 44 are formed by embedding a transparent disc-shaped plate in each side wall 69.

An agitator 45 is disposed in the toner-accommodating chamber 41 for agitating toner accommodated therein. The agitator 45 includes a rotational shaft 46 and an agitating member 47. The rotational shaft 46 is rotatably supported in the side walls 69 substantially in the center of the toner-accommodating chamber 41. The agitating member 47 is provided on the rotational shaft 46. A motor (not shown) produces a driving force that is inputted into the rotational shaft 46 for driving the rotational shaft 46 to rotate.

The agitator 45 also includes wipers 48 attached at both axial ends of the rotational shaft 46. When the rotational shaft 46 rotates, the wipers 48 move in a circular direction about the rotational shaft 46 through the toner-accommodating chamber 41 in order to wipe the toner detection windows 44 provided in the side walls 69. Hence, the wipers 48 function to clean the toner detection windows 44.

The developing chamber 42 occupies an interior space in the rear side of the casing 36 partitioned by the partitioning wall 40. The developing chamber 42 accommodates the supply roller 37, the developing roller 38, and the thickness-regulating blade 39 and is provided with the plate wall 349.

The supply roller 37 is disposed rearward of the opening 43 above the center bottom wall 78 of the developing chamber 42. The supply roller 37 opposes the developing roller 38 diagonally from the lower front side so that the top of the supply roller 37 is lower than the top edge of the lower portion of the partitioning wall 40.

The supply roller 37 includes a metal roller shaft 50 covered by a sponge roller 51 formed of an electrically conductive foam material. The supply roller 37 is supported in the side walls 69 of the developer side casing 36 in contact with the developing roller 38 so that both are compressed to a degree. Specifically, through-holes 122 are provided in each of the side walls 69 at positions opposing each other in the width direction. The supply roller shaft 50 is inserted into the through-holes 122 so that the supply roller 37 is rotatably supported in the developer side casing 36.

A driving force from a motor (not shown) is inputted into the supply roller shaft 50 for driving the supply roller 37 to rotate. The supply roller 37 rotates counterclockwise in FIG. 11 so that the peripheral surface of the supply roller 37 moves in the opposite direction of the developing roller 38 at the point of contact between the two rollers.

The developing roller 38 is disposed above the rear bottom wall 379 of the developing chamber 42 on the opposite side of the supply roller 37 from the toner-accommodating chamber 41 in the front-to-rear direction, that is, rearward of the supply roller 37. The developing roller 38 opposes the supply roller 37 diagonally from the upper rear side and contacts the supply roller 37 with pressure.

The developing roller 38 is disposed so that substantially the upper half of the developing roller 38 is above the top of the supply roller 37. The developing roller 38 has a larger diameter than the supply roller 37 and includes the metal developing roller shaft 52 mentioned above, and a rubber roller 53 formed of an electrically conductive rubber material that covers the developing roller shaft 52. The rubber roller 53 is more specifically formed of an electrically conductive urethane rubber or silicon rubber containing fine carbon particles or the like, the surface of which is coated with urethane rubber or silicon rubber containing fluorine. The developing roller shaft 52 is supported in the side walls 69 of the developer side casing 36 within the developing chamber 42.

The developing roller 38 is supported in the side walls 69 so as to protrude out of the developer side casing 36 through the rear opening 94. More specifically, through-holes 121 are formed in both side walls 69 of the developer side casing 36 at positions near the rear end thereof so as to oppose each other in the width direction. The developing roller shaft 52 is inserted through the through-holes 121 so that the developing roller 38 is rotatably supported in the developer side casing 36 with a vertical center portion of the rubber roller 53 protruding farthest out of the developer side casing 36 through the rear opening 94.

The developing roller 38 is driven to rotate counterclockwise in FIG. 11 by a driving force inputted into the developing roller shaft 52 from a motor (not shown). Further, a developing bias is applied to the developing roller 38 during a developing operation.

The thickness-regulating blade 39 is disposed in the developing chamber 42 above the developing roller 38 and rearward of the plate wall 349 described later. The blade-mounting part 373 supported on the rear side of the side walls 69 holds the thickness-regulating blade 39 at both widthwise ends thereof.

The thickness-regulating blade 39 includes a main blade member 54 configured of a metal leaf spring that is rectangular in a front view (see FIG. 13), and a pressing part 55 provided on a distal end of the main blade member 54. The main blade member 54 includes an upper end 383, which is a base end mounted in the blade-mounting part 373, and a lower end 84, which is the distal end on which the pressing part 55 is provided. The pressing part 55 has a semicircular cross section and is formed of an insulating silicon rubber.

Figure 13:
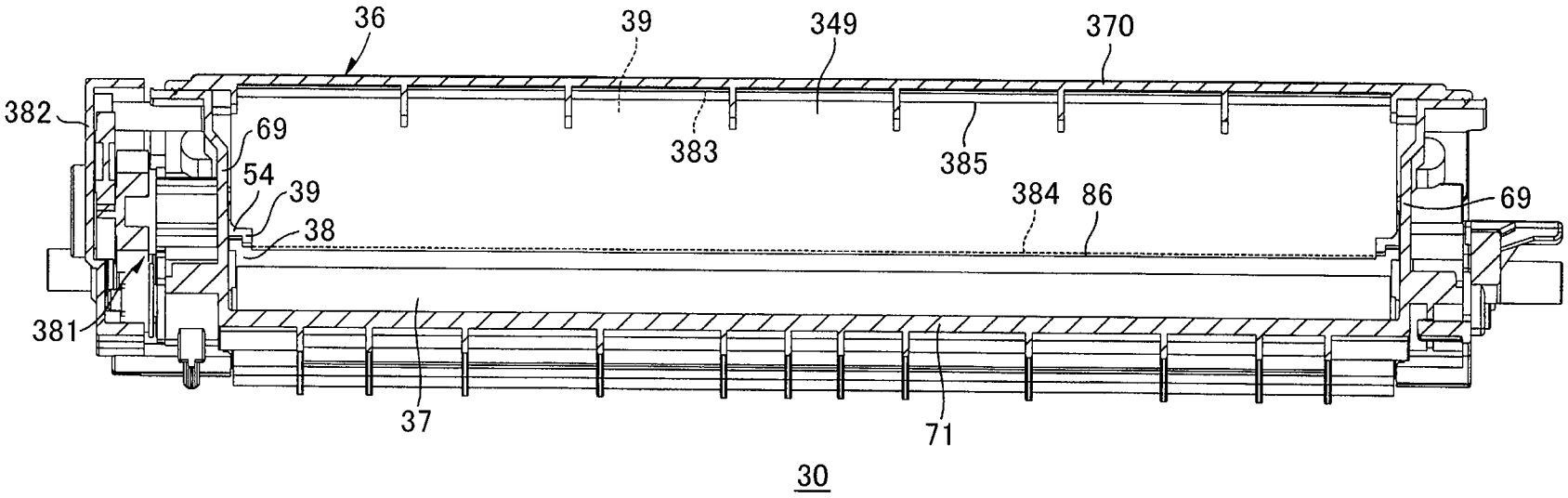
FIG. 13 is a cross-sectional view of the developer cartridge along a line A-A in FIG. 11.

As shown in FIG. 13, the thickness-regulating blade 39 extends in the width direction along the rear face of the blade-mounting part 373. As shown in FIG. 11, the mounting member 109 fixes the upper end 383 of the main blade member 54 to the rear face of the blade-mounting part 373 supported in the rear end of the side walls 69 at both widthwise ends thereof.

A sealing member 110 is interposed between the rear face of the blade-mounting part 373 and the mounting member 109 to prevent toner from leaking therethrough.

The mounting member 109 includes a plate-shaped front support member 115, the back support member 111 having a substantially L-shaped cross section, and a screw 112. The front support member 115 is disposed on the rear side of the sealing member 110. The upper end 383 of the main blade member 54 is disposed on the rear side of the front support member 115, and the back support member 111 is disposed on the rear side of the upper end 383. The screw 112 is inserted through the back support member 111, the upper end 383 of the main blade member 54, and the front support member 115 in the front-to-rear direction for fixing these components together. A screw 130 fixes the upper end 383 of the main blade member 54 together with the mounting member 109 to the blade-mounting part 373 with the sealing member 110 interposed therebetween.

Hence, the main blade member 54 is disposed such that the upper end 383 is supported on the rear face of the blade-mounting part 373, which slopes obliquely downward to the front, and the lower end 384 in turn extends diagonally downward toward the front from the upper end 383 to the supply roller 37, approaching the developing roller 38 and plate wall 349 therebetween. Accordingly, the thickness-regulating blade 39 extends downward and forward from the upper end 383 to the lower end 384 while gradually approaching the plate wall 349.

The pressing part 55 extends in the width direction along the rear surface on the lower end 384 of the main blade member 54. The pressing part 55 is urged rearward by the elastic force of the main blade member 54 to contact the rubber roller 53 of the developing roller 38 with pressure at a position above and slightly rearward of the point of contact between the developing roller 38 and supply roller 37.

The plate wall 349 is integrally formed with the top cover 370 and is disposed in the developing chamber 42 above the supply roller 37 and between the thickness-regulating blade 39 and partitioning wall 40 in the front-to-rear direction. As shown in FIG. 13, the plate wall 349 has a rectangular plate shape in a front view, extending through the developing chamber 42 in the width direction so as to partition the thickness-regulating blade 39 from the toner-accommodating chamber 41. The plate wall 349 includes a base end 385, which is the upper end, and a free end 386, which is the lower end.

The base end 385 of the plate wall 349 is connected to the bottom surface of the top cover 370 between the upper portion of the partitioning wall 40 and the blade-mounting part 373. The free end 386 of the plate wall 349 extends vertically downward from the base end 385 toward the supply roller 37. In the front-to-rear direction, the free end 386 of the plate wall 349 is positioned between a contact part X at which the pressing part 55 of the thickness-regulating blade 39 contacts the developing roller 38 (see FIG. 12) and the front edge of the supply roller 37. Specifically, the base end 385 of the plate wall 349 is vertically aligned with the sponge roller 51 of the supply roller 37.

Accordingly, the plate wall 349 extends vertically downward from the upper end to the lower end so that the free end 386 approaches the pressing part 55 of the thickness-regulating blade 39 and the supply roller 37. With respect to the vertical direction, the free end 386 of the plate wall 349 extends below the pressing part 55 and is separated from the supply roller 37. Further, the upper end 383 and base end 385 of the thickness-regulating blade 39 and plate wall 349, respectively, are supported on the top cover 370 and the respective lower end 384 and free end 86 extend toward the supply roller 37. Accordingly, the top cover 370, thickness-regulating blade 39, and plate wall 349 form a substantially rectangular shape in a cross section that grows narrow toward the bottom (that is, toward the supply roller 37). Here, the lower end 384 of the thickness-regulating blade 39 and the free end 386 of the plate wall 349 are separated slightly in the front-to-rear direction.

Figure 12:
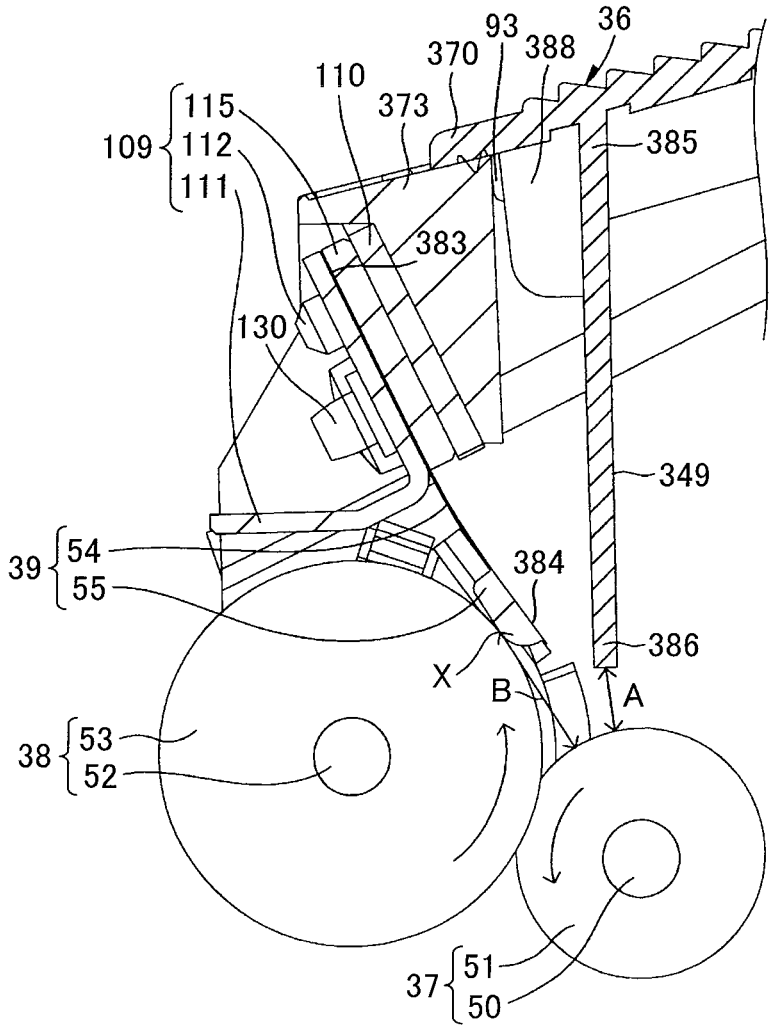
FIG. 12 is an enlarged side cross-sectional view showing a portion of the developing chamber near a supply roller, developing roller, thickness-regulating blade, and plate wall.

As shown in FIG. 12, the free end 386 of the plate wall 349 is positioned so that a shortest distance A between the free end 386 of the plate wall 349 and the surface of the sponge roller 51 on the supply roller 37 is shorter than a shortest distance B between the contact part X at which the pressing part 55 of the thickness-regulating blade 39 contacts the developing roller 38 and the surface of the sponge roller 51.

Therefore, as shown in FIG. 13, the free end 386 of the plate wall 349 is positioned lower than the contact part X at which the pressing part 55 of the thickness-regulating blade 39 contacts the developing roller 38.

When a driving force is inputted into the agitator rotational shaft 46 from a motor (not shown), the agitator rotational shaft 46 is driven to rotate clockwise in FIG. 11 so that the agitating member 47 moves through the toner-accommodating chamber 41 in a circular direction around the agitator rotational shaft 46. In this way, the agitating member 47 stirs toner accommodated in the toner-accommodating chamber 41 and discharges some of the toner toward the developing chamber 42 via the opening 43.

Toner discharged toward the developing chamber 42 through the opening 43 is supplied onto the developing roller 38 by the rotating supply roller 37. At this time, the toner is positively tribocharged between the supply roller 37 and developing roller 38 since the surfaces of the two rollers move in opposite directions at the point of contact. As the developing roller 38 rotates, toner supplied from the supply roller 37 onto the developing roller 38 moves upward over the side of the supply roller 37 to the contact part X at which the pressing part 55 of the thickness-regulating blade 39 contacts the developing roller 38. At this contact part X, the toner passes between the pressing part 55 of the thickness-regulating blade 39 and the rubber roller 53 of the developing roller 38. At this time, the pressing part 55 scrapes off the excess portion of toner in order to maintain a thin layer of uniform thickness on the surface of the rubber roller 53.

In the developer cartridge 30 described above, the plate wall 349 is disposed between the thickness-regulating blade 39 and partitioning wall 40 and above the supply roller 37 for partitioning the thickness-regulating blade 39 from the toner-accommodating chamber 41. The free end 386 of the plate wall 349 is positioned such that the shortest distance A between the free end 386 of the plate wall 349 and the sponge roller 51 of the supply roller 37 is shorter than the shortest distance B between the contact part X at which the pressing part 55 of the thickness-regulating blade 39 contacts the developing roller 38 and the sponge roller 51 of the supply roller 37.

Toner is positively tribocharged between the supply roller 37 and developing roller 38 that rotate in the same direction so that the surfaces of the rollers at move in opposite directions in the area of contact. As the developing roller 38 rotates, some of the charged toner reaches the contact part X. At this time, the thickness-regulating blade 39 scrapes off the excess charged toner to form a thin layer of uniform thickness on the developing roller 38. The excess toner scraped off by the thickness-regulating blade 39 can be maintained between the thickness-regulating blade 39 and plate wall 349 and can once again be carried on the surface of the developing roller 38 and regulated by the thickness-regulating blade 39.

As a result, since excess charged toner scraped off by the thickness-regulating blade 39 can be prevented from returning to the toner-accommodating chamber 41, it is possible to control the charge of the toner reliably to prevent a decline in image quality.

Further, in the developer cartridge 30 of the illustrative example, the partitioning wall 40 is disposed midway in the developer side casing 36 in the front-to-rear direction for partitioning the developer side casing 36 into the toner-accommodating chamber 41 and developing chamber 42, and the plate wall 349 is disposed in the developing chamber 42. Hence, the partitioning wall 40 can prevent excess charged toner scraped off by the thickness-regulating blade 39 from returning to the toner-accommodating chamber 41 when the toner flows from the region between the thickness-regulating blade 39 and plate wall 349.

Hence, charged toner can be maintained in the developing chamber 42, thereby further preventing charged toner from returning to the toner-accommodating chamber 41. As a result, it is possible to control the charge of the toner more reliably and to further prevent a decline in image quality.

Further, the plate wall 349 is arranged so that the base end 385 is connected to the top cover 370 of the developer side casing 36, and the free end 386 is disposed between the contact part X at which the pressing part 55 of the thickness-regulating blade 39 contacts the developing roller 38 and the front side of the supply roller 37 in the front-to-rear direction.

With this construction, even when the excess charged toner scraped off by the thickness-regulating blade 39 flows along the plate wall 349 and forward from the free end 386 of the plate wall 349, the charged toner comes into contact with the supply roller 37, which again supplies the toner to the developing roller 38. Hence, charged toner is reliably kept between the thickness-regulating blade 39 and plate wall 349 through a simple construction, thereby reliably preventing the charged toner from returning to the toner-accommodating chamber 41.

In the developer cartridge 30 of the illustrative example, the thickness-regulating blade 39 gradually approaches the plate wall 349 from the upper end 383 to the lower end 384, and the pressing part 55 disposed on the lower end 384 pressingly contacts the rubber roller 53 of the developing roller 38 through the elastic force of the main blade member 54. Hence, this simple construction can reliably prevent excess charged toner scraped off by the pressing part 55 of the thickness-regulating blade 39 at the contact part X from flowing past the free end 386 of the plate wall 349 toward the toner-accommodating chamber 41, thereby further preventing charged toner from returning to the toner-accommodating chamber 41.

Further, in the developer side casing 36 described above, intersecting front-to-rear ribs 88 and widthwise ribs 89 are provided on the top cover 370 to form a lattice structure. In addition, the forward protruding parts 90 approaching the front edge of the top cover 370 are disposed on front ends of the two front-to-rear ribs 88 nearest the widthwise center of the top cover 370, and step parts 91 and laterally protruding parts 300 are provided on the two front-to-rear ribs 88 nearest the outer widthwise edges of the top cover 370, while rearward protruding parts 93 are disposed on the rear ends of the two front-to-rear ribs 88.

With this construction, the outermost edges of the lattice formed by the intersecting front-to-rear ribs 88 and widthwise ribs 89 are fitted into the top opening 395 so that the forward protruding parts 90, laterally protruding parts 300, and rearward protruding parts 93 contact corresponding inner surfaces of the top opening 395. Accordingly, the top cover 370 can be mounted on the main casing body 387 with precision so that the plate wall 349 provided on the top cover 370 can be accurately disposed at a desired position in the developer side casing 36.

The rearward protruding parts 93 disposed on the rear ends of the two front-to-rear ribs 88 nearest the widthwise edges of the top cover 370 contact widthwise ends of the blade-mounting part 373 at positions where the blade-mounting part 373 is supported on the side walls 69, that is, positions having a high rigidity with respect to the widthwise center. Therefore, this construction achieves stable positioning, improving the precision for assembling the top cover 370 on the main casing body 387.

Further, the forward protruding parts 90 disposed on the front ends of the two front-to-rear ribs 88 nearest the widthwise center of the top cover 370 contact the front wall 72 near the widthwise center of the front wall 72 where the front wall 72 has less rigidity and is more likely to flex than at the ends of the front wall 72 supported by the side walls 69. Therefore, this structure can prevent flexing in the widthwise center of the gear cover 382.

While dimension control must be executed rigorously at the areas of contact between the top cover 370 and main casing body 387, efforts to achieve this control cannot be reduced since the control is local, as described above.

In the developer cartridge 30 of the illustrative example, the toner can be reliably tribocharged since the surface of the supply roller 37 moves in a direction opposite the surface of the developing roller 38 at the region of contact with the developing roller 38. Further, the developing roller 38 rotates so that toner supplied from the supply roller 37 moves rearward on the upper half of the developing roller 38 so that the toner moves upward over the side of the supply roller 37 to reach the contact part X at which the pressing part 55 of the thickness-regulating blade 39 contacts the developing roller 38. Hence, since the surface of the supply roller 37 moves opposite the surface of the developing roller 38 at the region of contact therebetween, the surface of the supply roller 37 also moves rearward in the upper half thereof. Accordingly, the supply roller 37 can easily return excess charged toner that has been scraped off by the thickness-regulating blade 39 to the developing roller 38, while the supply roller 37 can also easily supply uncharged toner accommodated in the toner-accommodating chamber 41 to the developing roller 38.

The process cartridge 20 and the laser printer 1 of the illustrative example includes the developer cartridge 30 that is capable of preventing a decline in image quality by preventing excess charged toner scraped off by the thickness-regulating blade 39 from returning to the toner-accommodating chamber 41 in order to control the charge of the toner reliably. Accordingly, the process cartridge 20 and the laser printer 1 can accurately develop electrostatic latent images formed on the photosensitive drum 28 in order to form toner images with accuracy and, hence, can achieve high-quality image formation.

In the illustrative example described above, the developer cartridge 30 is detachably mounted on the drum cartridge 27 to form the process cartridge 20, and the process cartridge 20 is detachably mounted in the main casing 2. However, it is also possible to provide the photosensitive drum 28, charger 29, transfer roller 31, cleaning member 32, and the like in the main casing 2, while eliminating the drum cartridge 27, and to detachably mount the developer cartridge 30 in the main casing 2. It is also possible to eliminate both the drum cartridge 27 and developer cartridge 30 and to provide the photosensitive drum 28, charger 29, transfer roller 31, cleaning member 32, and the like in the main casing 2, as well as the toner-accommodating chamber 41, developing roller 38, supply roller 37, thickness-regulating blade 39, and plate wall 349.

Toner detection windows 44 are formed in both side walls 388 of the casing 36 for detecting the amount of toner remaining in the toner-accommodating chamber 41. The toner detection windows 44 are formed at positions in the side walls 388 near the partitioning wall 40 and oppose each other in the width direction. The toner detection windows 44 are transparent discs that are embedded into the side walls 388 of the casing 36.

A toner sensor (not shown) including a light-emitting element and a light-receiving element is disposed on the outer sides of the casing 36 opposing the toner detection windows 44. The light-emitting element emits a detection light into the toner-accommodating chamber 41 through one of the toner detection windows 44. After passing through the toner-accommodating chamber 41, the detection light exits through the other toner detection window 44 and is received by the light-receiving element. The toner sensor is configured to detect the amount of toner remaining in the toner-accommodating chamber 41 by measuring a detection time during which the detection light passes through both toner detection windows 44 while an agitator 45 described below stirs the toner in the toner-accommodating chamber 41.

Next, the agitator 45 and wipers 48 according to one illustrative example will be described in detail while referring to FIGS. 16 through 24C.

Figure 16:
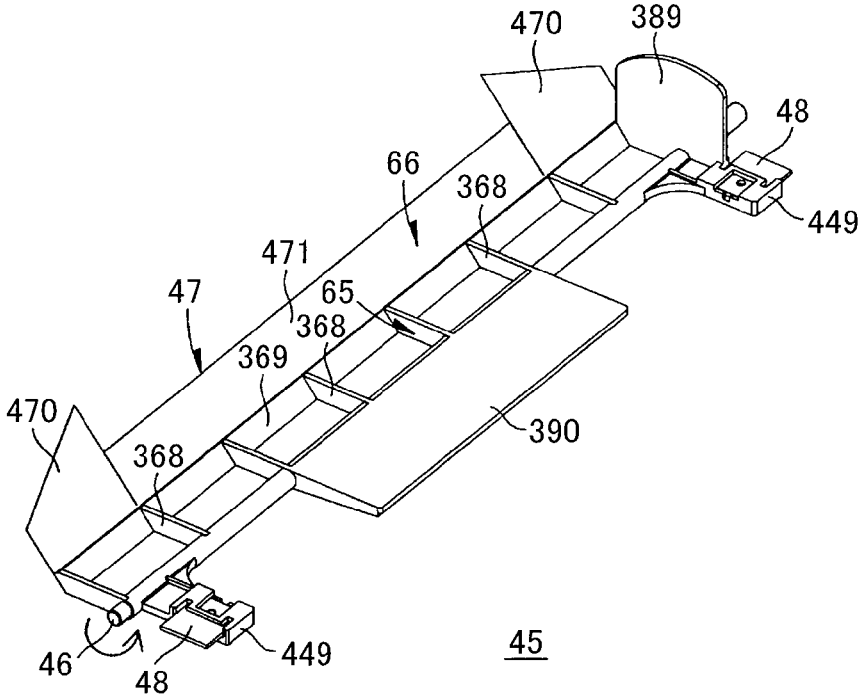
FIG. 16 is a perspective view of an agitator in the developer cartridge.

In addition to the rotational shaft 46, agitating member 47, and grid 49 described above, the agitator 45 also includes a light-blocking plate 389 and a guide plate 390, as shown in FIG. 16.

The agitating member 47 includes a film support member 65 extending radially outward from the rotational shaft 46, and a film 66 mounted on the film support member 65. The film support member 65 includes a plurality of cross plates 368 spaced at intervals from each other in the width direction of the rotational shaft 46, and a film support plate 369 linked to the rotational shaft 46 via the cross plates 368. Each cross plates 368 has a base end connected to the rotational shaft 46 and extends radially outward therefrom.

The film support plate 369 extends parallel to and is separated a prescribed distance from the rotational shaft 46 and is linked to the distal end of each cross plate 368. Hence, the rotational shaft 46, cross plates 368, and film support plate 369 are linked to form a ladder-like structure.

Figure 17:
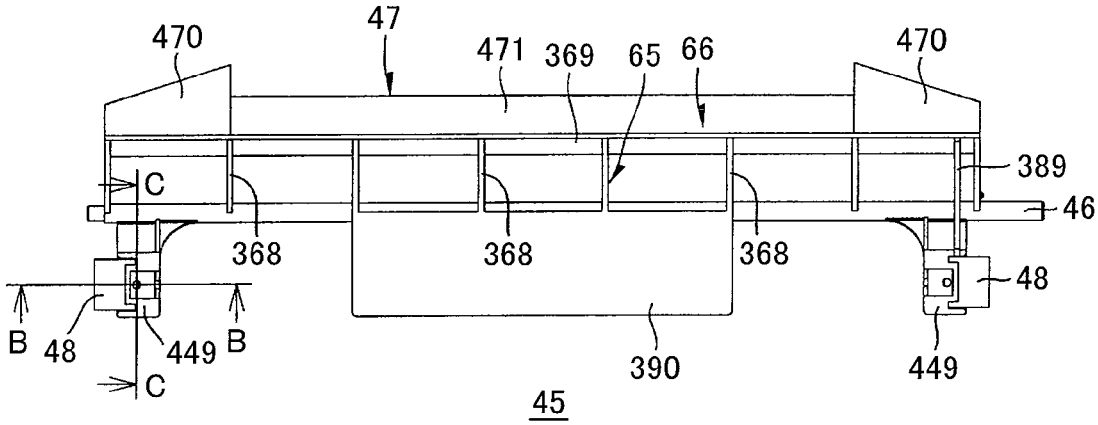
FIG. 17 is a plan view of the agitator.

The film 66 has a base edge fixed to the film support plate 369 along the width direction of the rotational shaft 46. As shown in FIG. 17, the film 66 is divided into sloped pieces 470 disposed on both ends in the width direction (identical to the width direction of the rotational shaft 46) whose free edges are sloped with respect to the width direction, and a rectangular piece 471 forming a center portion interposed between the two sloped pieces 470, whose free end is shorter than the sloped pieces 470 and aligned with the width direction.

As shown in FIG. 16, the film 66 is fixed to the film support plate 369 at a prescribed obtuse angle with respect to the extended direction of the cross plates 368. As shown in FIG. 17, the light-blocking plate 389 is integrally formed with the cross plate 368 positioned just inside the outermost cross plate 368 in the width direction on one widthwise end of the rotational shaft 46. As shown in FIG. 16, the light-blocking plate 389 has a plate shape and extends in a plane orthogonal to the axial direction of the rotational shaft 46. The light-blocking plate 389 functions to block at regular intervals the detection light emitted by the toner sensor for enhancing the precision for detecting residual toner.

The guide plate 390 extends radially outward from the rotational shaft 46 in the direction opposite the direction of the film 66. The guide plate 390 has a substantially rectangular plate shape of uniform thickness and is formed in an axial center region of the rotational shaft 46, extending in a direction opposite the extended direction of the cross plates 368. When the agitator 45 rotates, the guide plate 390 functions to evenly distribute toner in the toner-accommodating chamber 41 in the width direction thereof, and scrapes up toner such that the toner flows toward both widthwise ends of the toner-accommodating chamber 41.

The fixing members 449 are disposed one on each widthwise end of the rotational shaft 46. As shown in FIG. 17, each fixing member 449 is integrally configured of a support plate 472, a gripping plate 473, a connecting wall 474, and a restricting plate 475. Each support plate 472 has a substantially rectangular plate shape in a plan view. The support plates 472 are separated a prescribed distance from the guide plate 390 in the width direction of the rotational shaft 46 (see FIG. 4) and extend in a direction opposite the extended direction of the cross plates 368.

Figure 23:
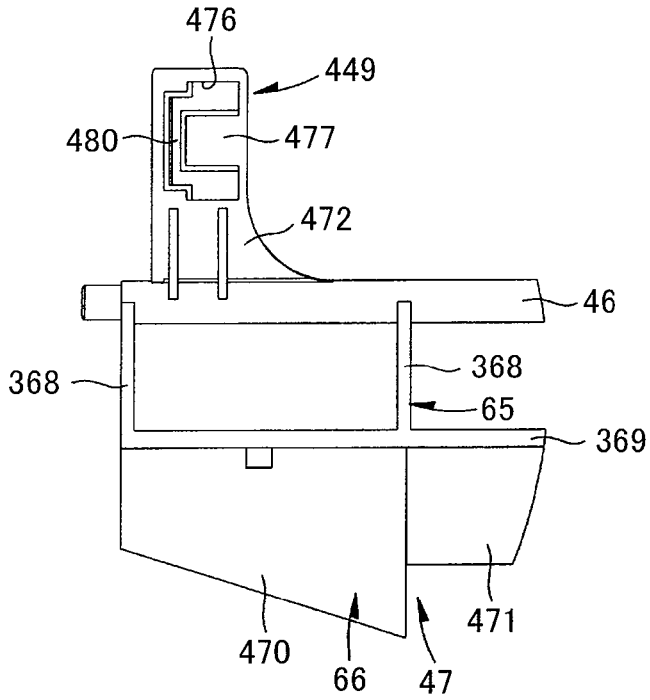
FIG. 23 is a bottom view showing the axial end of the agitator.

As shown in FIG. 23, a first cutout part 476 is formed in the support plate 472. The first cutout part 476 is substantially U-shaped in a bottom view. The first cutout part 476 is formed in a portion of the support plate 472 opposing the gripping plate 473 along an extended direction in which the support plate 472 extends from the rotational shaft 46. The first cutout part 476 extends from a downstream end in the insertion direction for the wipers 48 (an inside end in the axial direction of the rotational shaft 46) toward an upstream end in the insertion direction (toward the outside in the axial direction of the rotational shaft 46). Here, the extended direction includes both the direction from a base end of the support plate 472 connected to the rotational shaft 46 toward the free end of the support plate 472 and the direction from the distal end to the base end.

Figure 20:
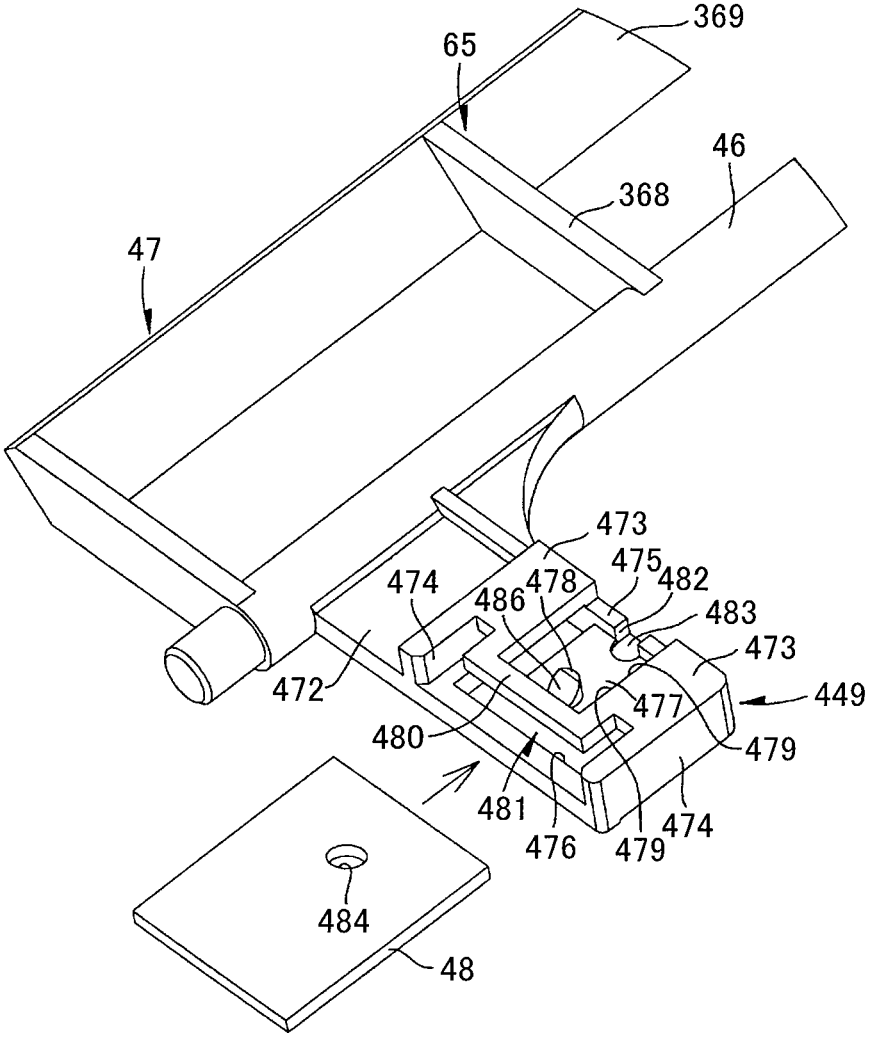
FIG. 20 is a perspective view showing an axial end of the agitator prior to mounting a wiper.
Figure 22:
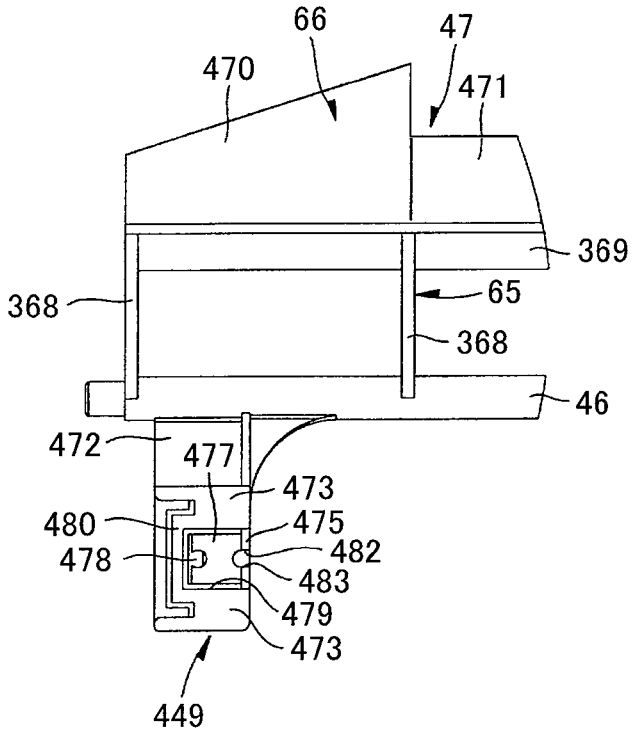
FIG. 22 is a plan view showing the axial end of the agitator.

As shown in FIGS. 20 and 22, the first cutout part 476 surrounds a center part 477 of the support plate 472. A boss 478 disposed on the center part 477 protrudes inward in the direction that the support plate 472 opposes the gripping plate 473.

The boss 478 is disposed on an upstream end of the center part 477 in the insertion direction and has a sloped surface 486 formed on the end thereof. The sloped surface 486 slopes inward in the direction that the support plate 472 opposes the gripping plate 473 from the upstream side toward the downstream side in the insertion direction.

Figure 18:
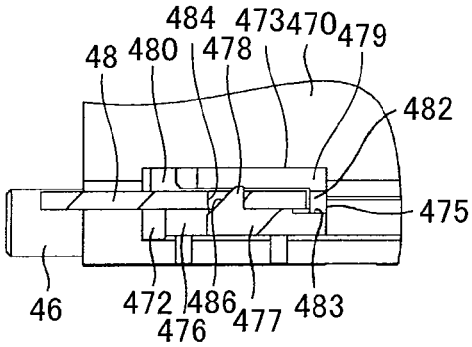
FIG. 18 is a cross-sectional view of a portion of the agitator indicated by the line B-B in FIG. 17.
Figure 19:
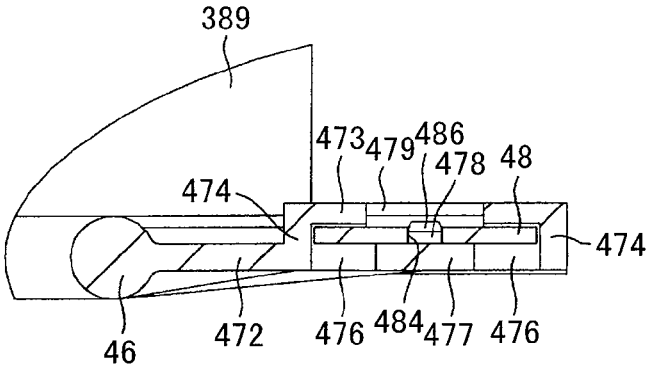
FIG. 19 is a cross-sectional view of a portion of the agitator indicated by the line C-C in FIG. 17.

As shown in FIGS. 18 and 19, the gripping plate 473 spans from a midpoint in the extended direction of the support plate 472 to the distal end thereof and opposes the support plate 472 across a gap corresponding to the thickness of the wiper 48.

As shown in FIGS. 20 and 22, the gripping plate 473 is formed in a portion opposing the first cutout part 476 and is substantially U-shaped in a plan view, nearly identical in shape to the first cutout part 476. A second cutout part 479 is formed in a region of the gripping plate 473 opposing the center part 477 formed in the support plate 472 and is encompassed by the gripping plate 473.

A portion of the gripping plate 473 extending in the extended direction of the support plate 472 along the upstream side of the second cutout part 479 in the insertion direction serves as a pressing plate 480. The pressing plate 480 functions to prevent the wiper 48 from floating off the support plate 472.

The connecting walls 474 run parallel to each other in the insertion direction and are separated from each other in the extended direction of the support plate 472 by a prescribed gap corresponding to the width of the wiper 48. The connecting walls 474 link the support plate 472 to both ends of the gripping plate 473 in the extended direction.

With this construction, a slit 481 for receiving the wiper 48 is formed in the fixing member 449 and is defined by the support plate 472, the gripping plate 473, and the connecting walls 474.

The restricting plate 475 is disposed along the downstream end of the support plate 472 with respect to the insertion direction and extends in the extended direction of the support plate 472. The restricting plate 475 protrudes from the support plate 472 toward the area encompassed by the gripping plate 473 and links the support plate 472 and gripping plate 473 in a region that the support plate 472 opposes the gripping plate 473.

A jig insertion part 482 is provided as a cutout portion in the restricting plate 475, forming a gap in the extended direction of the support plate 472 so that the support plate 472 is in communication with the center part 477. A depression 483 that is U-shaped in a plan view is formed in a portion of the support plate 472 in communication with the jig insertion part 482.

The rotational shaft 46, film support member 65 of the agitating member 47, fixing members 449, light-blocking plate 389, and guide plate 390 of the agitator 45 are integrally formed of a hard synthetic resin such as an ABS resin, while the film 66 is a flexible film formed of a resin, such as polyethylene terephthalate.

As shown in FIG. 20, the wiper 48 is plate-shaped and substantially rectangular in a plan view. The wiper 48 is formed of a flexible elastic member, such as urethane rubber.

Figure 21:
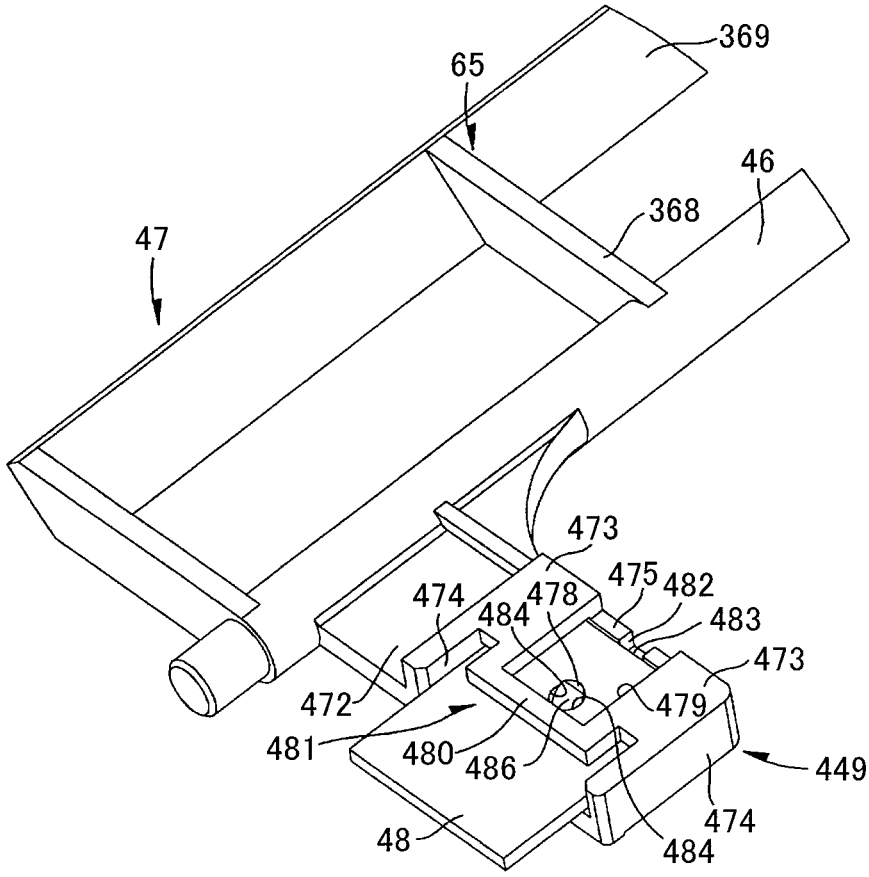
FIG. 21 is a perspective view showing the axial end of the agitator after mounting the wiper.

As shown in FIG. 19, the wiper 48 is formed with substantially the same width (dimension of the wiper 48 in a direction orthogonal to the insertion direction and the thickness direction) as the width in the extended direction of the slit 481 formed in the fixing member 449. The thickness of the wiper 48 is substantially the same as the width of the opening formed by the slit 481 in the direction that the support plate 472 confronts the gripping plate 473, as shown in FIGS. 18 and 19. The length of the wiper 48 in the insertion direction is longer than the depth of the slit 481 in the insertion direction by about two times, as shown in FIGS. 18 and 21.

The wiper 48 has a through-hole 484 with a circular cross section formed therein. When the wiper 48 is inserted into the slit 481 formed in the fixing member 449, the through-hole 484 formed in the wiper 48 is positioned at the boss 478 for receiving the boss 478 therein.

Next, a process of mounting the wiper 48 in the fixing member 449 will be described with reference to FIGS. 7, 8, and 11.

Figure 24A:
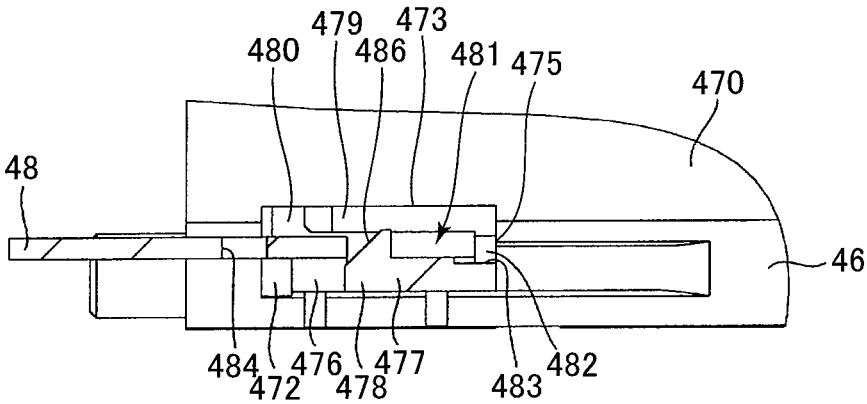
FIG. 24A is a cross-sectional view illustrating the process of assembling the wiper directly after the wiper is inserted into the slit.
Figure 24B:
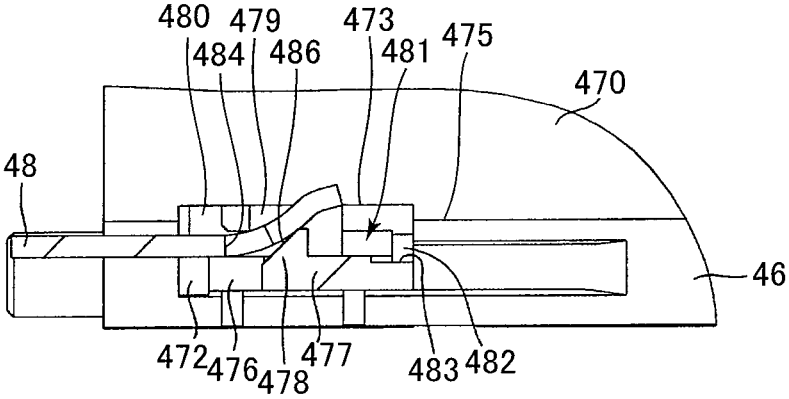
FIG. 24B is a cross-sectional view illustrating the process of assembling the wiper as the wiper is inserted farther into the slit.
Figure 24C:
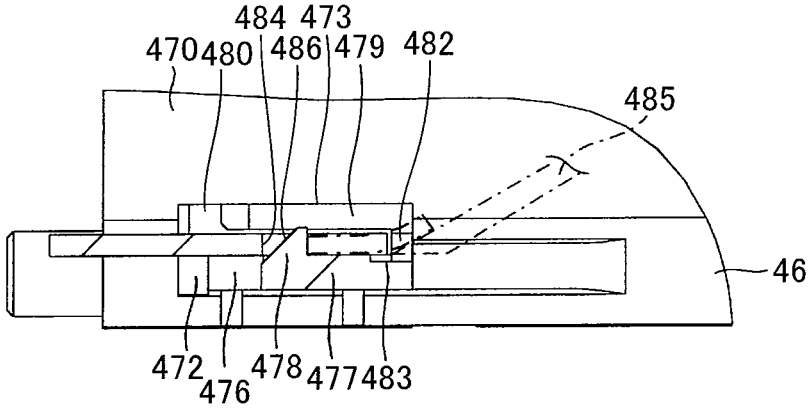
FIG. 24C is a cross-sectional view illustrating the process of assembling the wiper after the wiper has been completely inserted into the slit.

As illustrated in FIG. 20, the wiper 48 is positioned opposite the slit 81 and inserted into the slit 481 in the direction of the arrow. FIGS. 24A through 24C illustrate the process of inserting the wiper 48 into the slit 481. After the downstream end of the wiper 48 in the insertion direction passes between the support plate 472 and the pressing plate 480 of the gripping plate 473, as shown in FIG. 24A, the downstream end contacts the boss 478. As the wiper 48 is inserted farther, the wiper 48 flexes so that the downstream end of the wiper 48 slides over the boss 478, as shown in FIG. 24B. As shown in FIG. 24C, the wiper 48 has been inserted until the downstream end contacts the restricting plate 475, which prevents further movement downstream in the insertion direction. At this time, the boss 478 is received in the through-hole 484 so as to penetrate the wiper 48 in the thickness direction of the same. 484 the boss 478 is received in the through-hole 484, the wiper 48 is interposed between the support plate 472 and the gripping plate 473 and, therefore, is mounted in the fixing member 449.

When the wiper 48 is mounted in the fixing member 449, as shown in FIG. 21, the boss 478 is inserted through the through-hole 484, preventing the wiper 48 from being removed from the fixing member 449. Further, the pressing plate 480 restricts the wiper 48 from rising off the support plate 472, thereby fixing the wiper 48 in the fixing member 449.

However, the wiper 48 can be removed from the fixing member 449 with a sharp needle-like jig 485 shown in phantom in FIG. 24C. The jig 485 is inserted through the jig insertion part 482 and between the downstream end of the wiper 48 in the insertion direction and the depression 483 of the support plate 472 to lift the downstream end of the wiper 48 off the support plate 472. In this state, the through-hole 484 can be lifted off the boss 478 so that the wiper 48 can be subsequently pulled through the slit 481 and removed from the fixing member 449.

In the agitator 45 described above, the wiper 48 is fixed to the fixing member 449 by being inserted into the slit 481 of the fixing member 449 and, therefore, is fixed to the agitating member 47 of the agitator 45 via the fixing member 449. Further, the fixing member 449 is integrally formed of the agitating member 47. Accordingly, the wiper 48 can be fixed to the agitating member 47 through a simple assembly that requires no special parts such as double-sided tape or a push nut for fixing the wiper 48 to the agitating member 47. Therefore, this construction reduces the number of required parts and improves the efficiency of the assembly operation. Further, since the wiper 48 is fixed to the fixing member 449 through insertion into the slit 481, the wiper 48 can be removed easily, making the wiper 48 more suitable to recycling.

The wiper 48 is inserted and held between the support plate 472 and gripping plate 473, thereby reliably fixing the wiper 48 through a simple construction.

Further, with respect to the opposing portions of the support plate 472 and gripping plate 473 between which the wiper 48 is inserted, the first cutout part 476 opposing the gripping plate 473 is formed in the support plate 472, and the second cutout part 479 opposing the support plate 472 is formed in the gripping plate 473. In other words, only one of the support plate 472 and gripping plate 473 is formed in the opposing portions of the support plate 472 and gripping plate 473 between which the wiper 48 is inserted, thereby facilitating removal of the members when molding the support plate 472 and gripping plate 473. Further, toner that enters the slit 481 can easily be cleaned out during recycling.

When the wiper 48 is inserted into the slit 481 formed in the fixing member 449, the boss 478 is inserted into the through-hole 484 formed in the wiper 48, thereby more securely fixing the wiper 48 to the fixing member 449 and, by extension, to the agitating member 47.

The sloped surface 486 of the boss 478 is formed to slope inward in the direction that the support plate 472 opposes the gripping plate 473 from the upstream to the downstream side in the insertion direction.

As the wiper 48 is inserted downstream into the fixing member 449, the sloped surface 486 of the boss 478 guides the wiper 48 in a slanted direction. After the downstream end of the wiper 48 slides over the boss 478, the boss 478 becomes inserted into the through-hole 484 of the wiper 48. This construction enables the wiper 48 to be mounted smoothly.

After the boss 478 is inserted into the through-hole 484 of the wiper 48, the boss 478 prevents removal of the wiper 48 since the sloped surface 486 of the boss 478 is on the downstream side in the direction for removing the wiper 48.

Further, when the wiper 48 is mounted in the fixing member 449, the pressing plate 480 restricts the wiper 48 from floating off the support plate 472, thereby reliably preventing the through-hole 484 of the wiper 48 from slipping off the boss 478. In this way, the wiper 48 can be firmly fixed.

Further, when mounting the wiper 48 in the fixing member 449, the restricting plate 475 restricts the wiper 48 from being inserted excessively downstream, thereby reliably fixing the wiper 48 in a prescribed position.

For removing the wiper 48 from the fixing member 449, the jig 485 is inserted through the jig insertion part 482, enabling the developing chamber 42 to be peeled easily from the support plate 472. In this way, recycling can be facilitated.

Further, since the wiper 48 is formed of a flexible elastic material, such as urethane rubber, the wiper 48 readily flexes when mounted in or removed from the fixing member 449, enabling the through-hole 484 to be fitted over or removed from the boss 478. As a result, this construction facilitates insertion of the wiper 48 in the slit 481 and can improve the efficiency of the assembly operation. The construction also facilitates the removal of the wiper 48 from the slit 481, making the wiper 48 more suitable for recycling.

Since the developer cartridge 30 of the illustrative example can be constructed with less components and can provide a more efficient assembly process, as described above, the process cartridge 20 equipped with the developer cartridge 30 and the laser printer 1 equipped with the process cartridge 20 can be manufactured at a reduced cost and can be more suitable for recycling.

By employing a structure in the toner-accommodating chamber 41 for inserting the wiper 48 into the slit 481 of the fixing member 449 and fixing the wiper 48 to the fixing member 449, the developer cartridge 30 described above has the following effects. This structure prevents impurities from double-sided tape or other special parts from entering the toner accommodated in the toner-accommodating chamber 41, which toner is supplied for development, by eliminating the need for such special parts. Further, this construction prevents the occurrence of chemical reactions between toner and the adhesive layers of the double-sided tape.

In the illustrative example described above, the boss 478 is disposed on the support plate 472 and the pressing plate 480 on the gripping plate 473. However, the boss 478 may instead be disposed on the gripping plate 473, while the pressing plate 480 is disposed on the support plate 472.

Figure 25A:
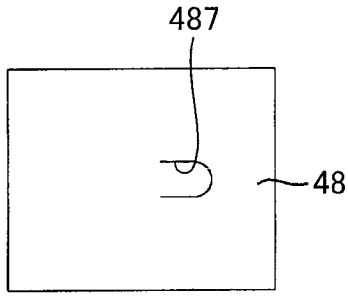
FIG. 25A is a plan view of a wiper according to a variation of the illustrative example.
Figure 25B:
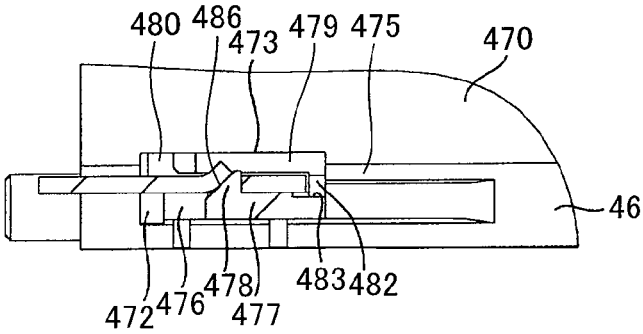
FIG. 25B is a cross-sectional view showing the wiper of FIG. 25A mounted on a fixing member.

In the illustrative example described above, the through-hole 484 is formed in the wiper 48 for inserting the boss 478. However, the receiving part of the invention for receiving the boss 478 need not be the through-hole 484, provided that the receiving part can receive the boss 478 being inserted in the thickness direction of the wiper 48. For example, a slit 487 that is substantially U-shaped in a plan view may be cut through the wiper 48 in the thickness direction, as shown in FIG. 25A. With this construction, the slit 487 can receive the boss 478 being inserted through the wiper 48 in the width direction, as illustrated in FIG. 25B.

Further, in the illustrative example described above, the guide plate 390 of the agitator 45 is formed with a uniform thickness. However, it is possible instead to form the guide plate 390 thicker in the center region (with respect to the width direction of the rotational shaft 46) and growing thinner toward the widthwise ends (the outer ends in the width direction of the rotational shaft 46). When the agitator 45 rotates to stir the toner, the surface of the guide plate 390 scraping up the toner is formed as a sloped surface in which the center portion of the guide plate 390 is on the upstream side in the rotating direction of the agitator 45, while both widthwise ends of the guide plate 390 are on the downstream side.

The guide plate 390 formed in this way can guide the toner to flow more smoothly toward the widthwise sides of the toner-accommodating chamber 41. Hence, the guide plate 390 can distribute toner in the toner-accommodating chamber 41 more uniformly in the width direction of the toner-accommodating chamber 41.

Figure 26:
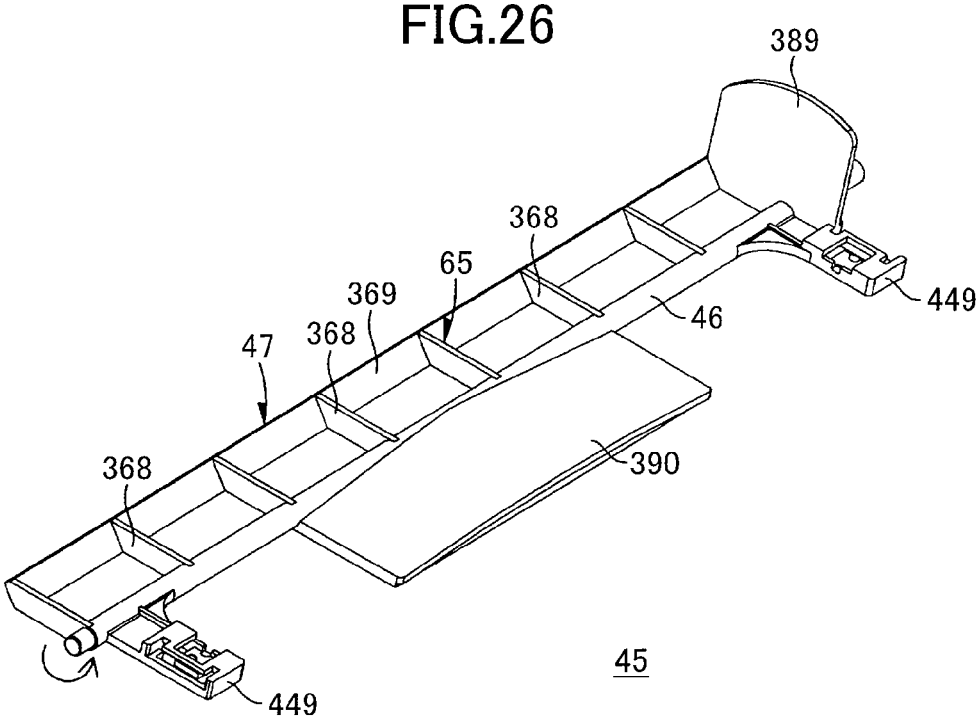
FIG. 26 is a perspective view of the agitator provided with a guide plate according to a variation of the illustrative example.

Note, the film 66 and wiper 48 have been omitted from the agitator 45 shown in FIG. 26.

Next, the shaft support unit 250 will be described in detail with reference to FIGS. 27 through 30. As will be described in detail below, a shaft support unit 250 is disposed on an inner wall of the developer-accommodating chamber 222. The shaft support unit 250 includes a guiding groove 250*a* for mounting the agitator shaft 223*a*, and a holding part 250*b* for rotatably holding the agitator shaft 223*a* (see FIG. 28).

One end of the agitator shaft 223*a* is rotatably held in a through-hole (not shown) formed in an inner wall of the developer-accommodating chamber 222 opposite the inner wall provided with the shaft support unit 250. The same end of the agitator shaft 223*a* is fitted into a gear (not shown). A motor (not shown) provided in the laser printer 1 transfers a driving force to the agitator shaft 223*a* via the gear.

Figure 27:
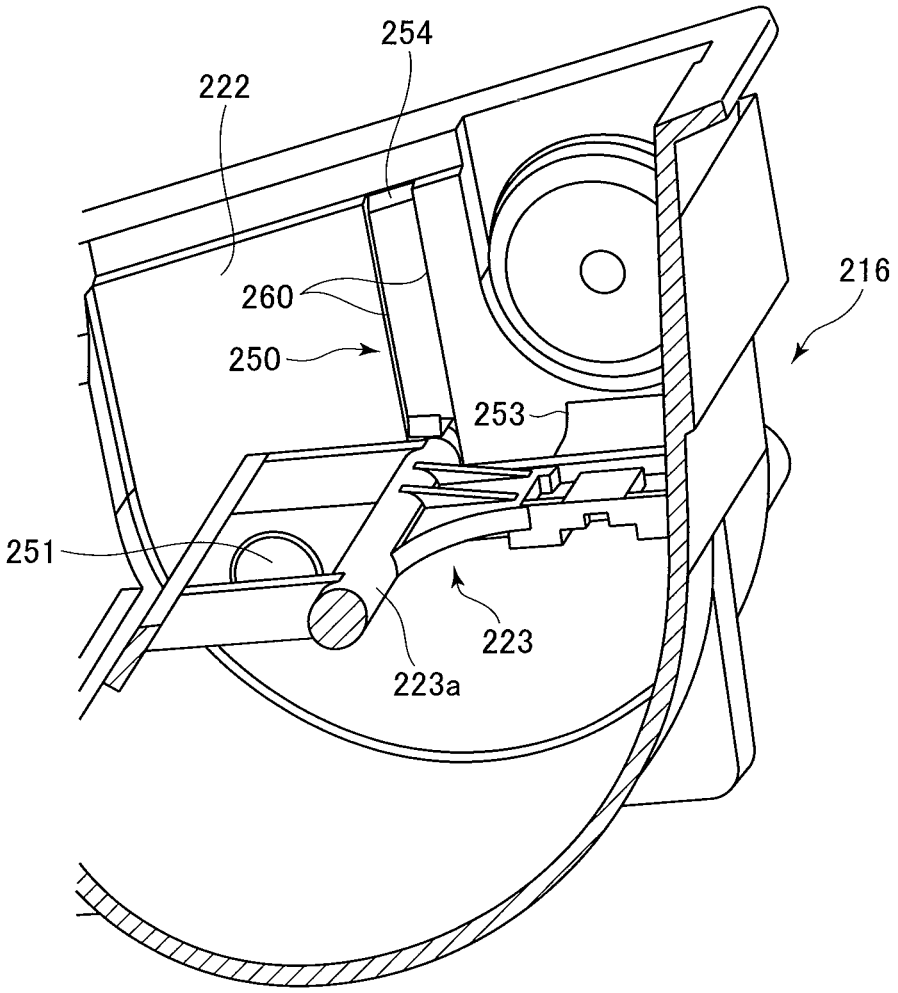
FIG. 27 is a perspective view inside a developer-accommodating chamber of the developer cartridge showing an agitator shaft that is held in a shaft support unit.
Figure 28:
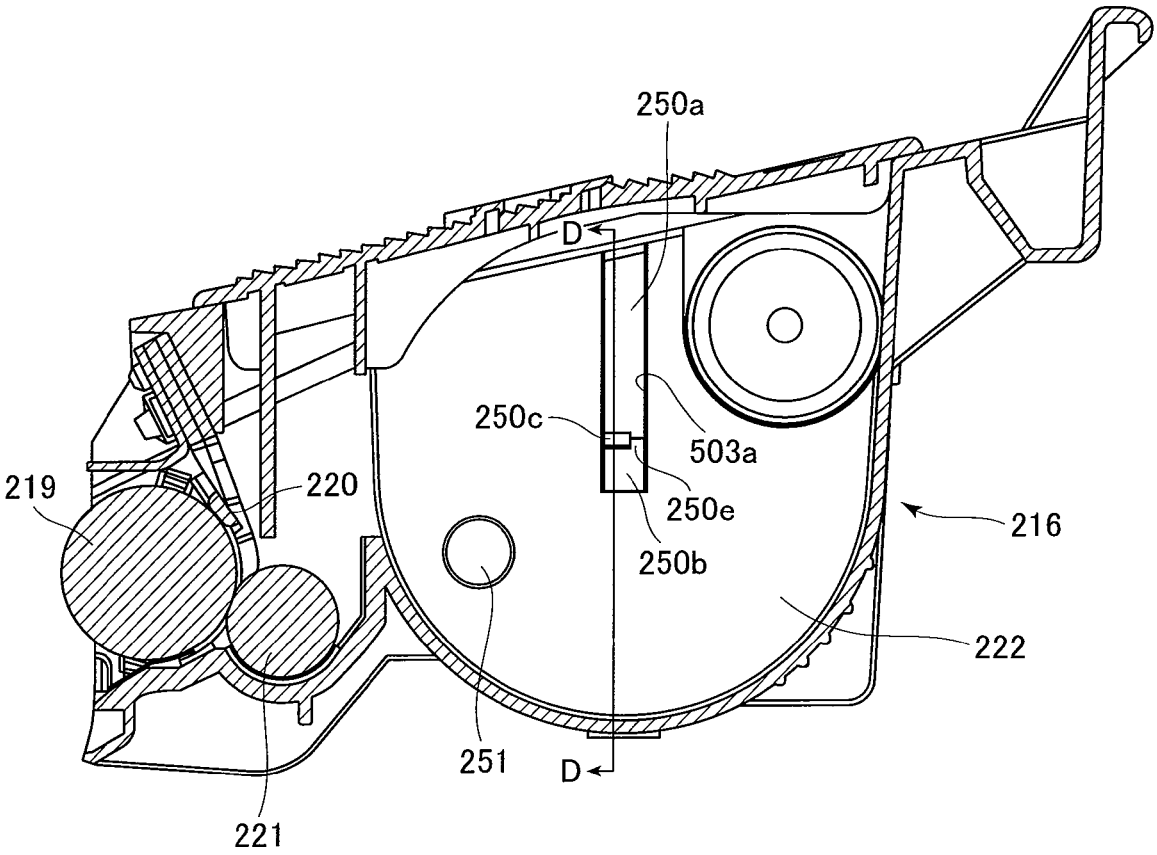
FIG. 28 is a center cross-sectional view of the developer cartridge without the agitator.
Figure 29:
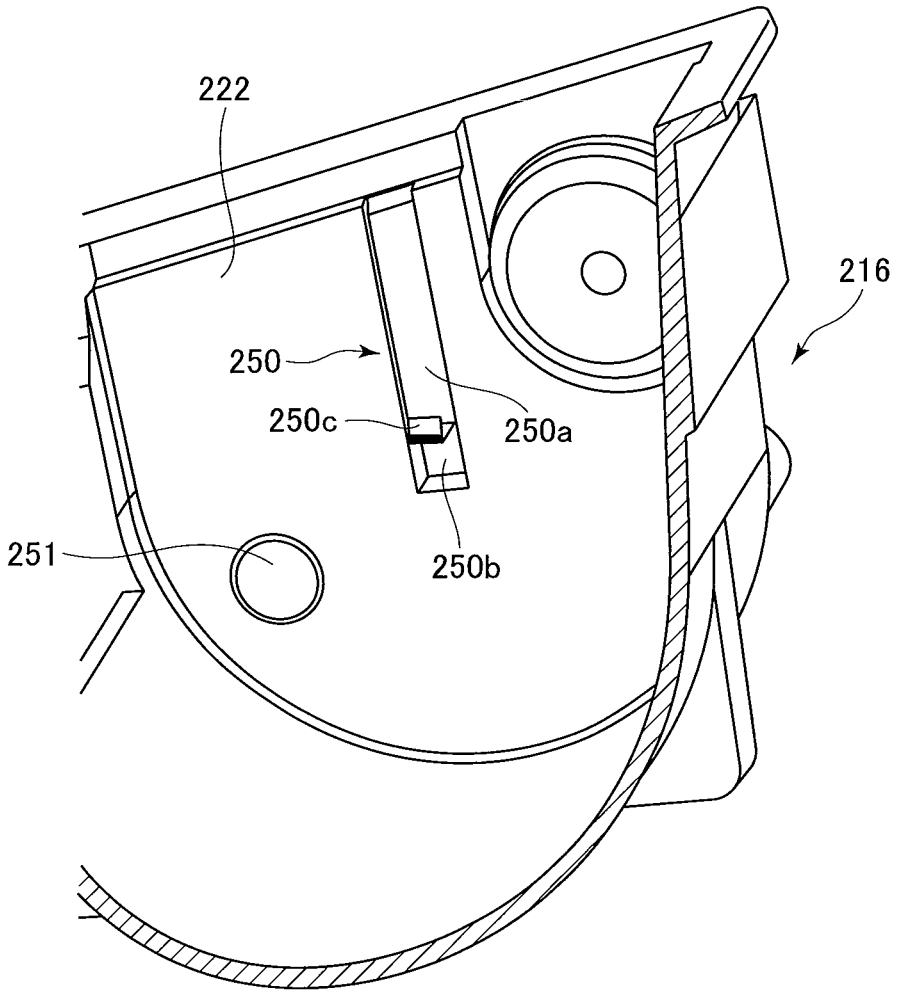
FIG. 29 is a perspective view showing the shaft support unit from inside the developer-accommodating chamber when the agitator shaft has been removed.
Figure 30:
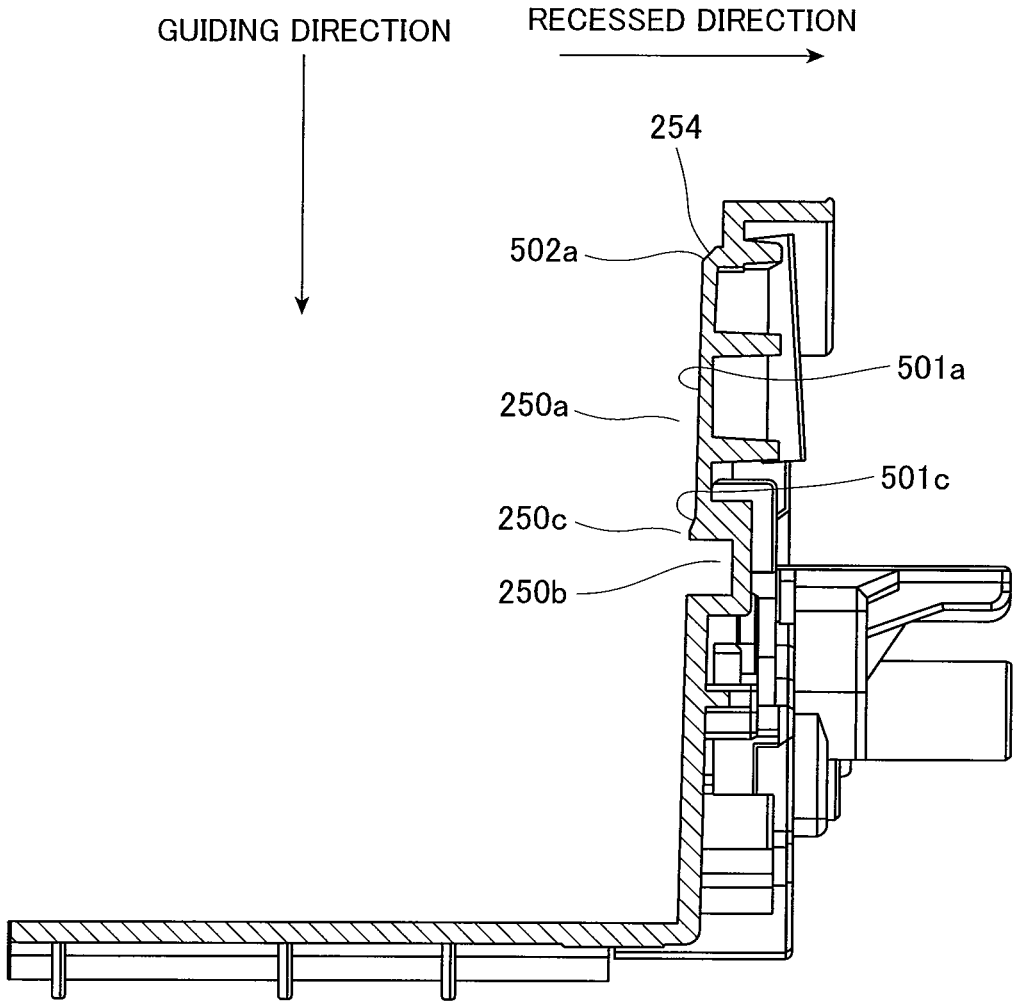
FIG. 30 is a cross-sectional view of the developer cartridge along a line D-D in FIG. 28.

As shown in FIG. 27, the other end of the agitator shaft 223*a* is rotatably held in the shaft support unit 250. As shown in FIGS. 28 and 30, the shaft support unit 250 includes the holding part 250*b* for rotatably holding the agitator shaft 223*a*, the guiding groove 250*a* for guiding the end of the agitator shaft 223*a* down toward the holding part 250*b*, and a restricting part 250*c* forming a boundary between the holding part 250*b* and the guiding groove 250*a* for restricting upward movement of the agitator shaft 223*a* held in the holding part 250*b*.

As shown in FIG. 30, the holding part 250*b* and guiding groove 250*a* form recessed parts in the inner wall of the developer-accommodating chamber 222. The recessed guiding groove 250*a* is shallower than the recessed holding part 250*b* in the recessed direction indicated in FIG. 30.

The guiding groove 250*a* has a shaft-confronting surface 501*a* that confronts the axial end of the agitator shaft 223*a* when mounting the agitator 223 in the developer-accommodating chamber 222. The shaft-confronting surface 501*a* slopes in a direction downward and opposite the recessed direction.

The restricting part 250*c* has a sloped surface 501*c* that is formed continuously with the shaft-confronting surface 501*a*. The sloped surface 501*c* slopes downward, that is, toward the holding part 250*b* and away from the shaft-confronting surface 501*a* in the direction opposite the recessed direction.

An introducing surface 254 is also formed on the inner wall of the developer-accommodating chamber 222. The introducing surface 254 slopes from a deeper position than the guiding groove 250*a* in the recessed direction toward the guiding groove 250*a* and is formed continuously with an edge 502*a* at the opening in the top of the shaft-confronting surface 501*a*.

As shown in FIG. 28, the guiding groove 250*a* has a side surface 503*a* for restricting movement of the agitator shaft 223*a* in a direction orthogonal to a guiding direction in which the agitator shaft 223*a* is guided toward the holding part 250*b*. A gap 250*e* is formed between the side surface 503*a* of the guiding groove 250*a* and the restricting part 250*c*. The gap 250*e* is smaller than the diameter of the agitator shaft 223*a*.

The holding part 250*b* has a polygonal shape in a cross section taken orthogonal to the axial direction of the agitator shaft 223*a*. In this illustrative example, the holding part 250*b* is substantially square-shaped in this cross section.

The widths of the guiding groove 250*a* and holding part 250*b* in a direction orthogonal to the guiding direction for the agitator shaft 223*a* are the same.

As shown in FIG. 27, the transparent windows 251 (only one is shown in FIG. 27; the other is provided in the inner wall of the developer-accommodating chamber 222 opposite the wall provided with the shaft support unit 250) are provided in side walls of the developer-accommodating chamber 222. A light source (not shown) disposed outside the developer cartridge 216 transmits a light beam through the transparent windows 251 for detecting the amount of residual toner in the developer-accommodating chamber 222. A flexible wiper 253 is disposed on the agitator 223 for slidingly contacting the transparent windows 251 as the agitator 223 rotates in order to clean the transparent windows 251. Beveled parts 260 are formed on edges of the shaft support unit 250 that are contacted by the flexible wiper 253.

Next, an operation for mounting the agitator 223 in the developer-accommodating chamber 222 will be described with reference to FIG. 30. First, one end of the agitator shaft 223*a* is fitted into the through-hole (not shown) formed in the developer-accommodating chamber 222. Next, the other end of the agitator 223 is lowered into contact with the edge 502*a*.

The guiding groove 250*a* guides this other end of the agitator shaft 223*a* toward the restricting part 250*c* as the agitator shaft 223*a* flexes. Next, the other end of the agitator shaft 223*a* is guided downward along the sloped surface 501*c*, which forces the other end of the agitator shaft 223*a* to move up on the restricting part 50*c* in a direction opposite the recessed direction. As the other end of the agitator shaft 223*a* is urged downward, the end slides over the restricting part 250*c* and becomes fitted into the holding part 250*b*. At this time, the agitator shaft 223*a* returns to a straight extension.

Since the guiding groove 250*a* formed on the inner wall of the developer-accommodating chamber 222 is shallower in the recessed direction than the holding part 250*b*, the agitator shaft 223*a* can be guided toward the restricting part 250*c* from a shallow position. This reduces the amount that the agitator shaft 223*a* must flex to slide over the restricting part 250*c*, thereby reducing the load applied to the agitator shaft 223*a* compared to the load applied when the guiding groove 250*a* and holding part 250*b* are formed at the same depth in the recessed direction.

Since the restricting part 250*c* has the sloped surface 501*c* linked to the shaft-confronting surface 501*a* for sloping downward and in the direction opposite the recessed direction, the agitator shaft 223*a* flexes gently when the end of the agitator shaft 223*a* slides over the restricting part 250*c*. As a result, this construction can reduce the load applied to the agitator shaft 223*a*.

The inner wall of the developer-accommodating chamber 222 includes the introducing surface 254 that slopes toward the guiding groove 250*a* and connects to the open end at the top of the shaft-confronting surface 501*a*. Accordingly, the agitator shaft 223*a* can be smoothly guided to the open end on top of the shaft-confronting surface 501*a*.

A gap 250*e* having a smaller diameter than the agitator shaft 223*a* is formed between the side surface 503*a* and the restricting part 250*c*. Accordingly, toner that accumulates in the holding part 250*b* can escape through the gap 250*e*. Hence, this structure can prevent toner from becoming packed between the agitator shaft 223*a* and holding part 250*b* and impeding the rotation of the agitator 223.

The holding part 250*b* is substantially square-shaped in a cross section taken orthogonal to the axial direction of the agitator shaft 223*a*. Accordingly, the peripheral surface of the agitator shaft 223*a* contacts the holding part 250*b* at points, reducing the frictional force generated between the peripheral surface of the agitator shaft 223*a* and the holding part 250*b*.

By forming the guiding groove 250*a* and holding part 250*b* with the same widths in the direction orthogonal to the guiding direction of the agitator shaft 223*a*, it is possible to minimize the space required for the guiding groove 250*a*.

The beveled parts 260 are formed on edges of the shaft support unit 250 that are contacted by the flexible wiper 253 so as not to promote degradation in the flexible wiper 253 due to sliding contact with the shaft support unit 250.

The shaft-confronting surface 501*a* of the guiding groove 250*a* slopes downward in a direction opposite the recessed direction. With this construction, the agitator shaft 223*a* flexes more gently when being mounted in the developer-accommodating chamber 222 and, hence, a smaller load is applied to the agitator shaft 223*a*.

Although present invention has been described with respect to specific illustrative examples, it will be appreciated by one skilled in the art that a variety of changes may be made without departing from the scope of present invention.

Figure 2B:
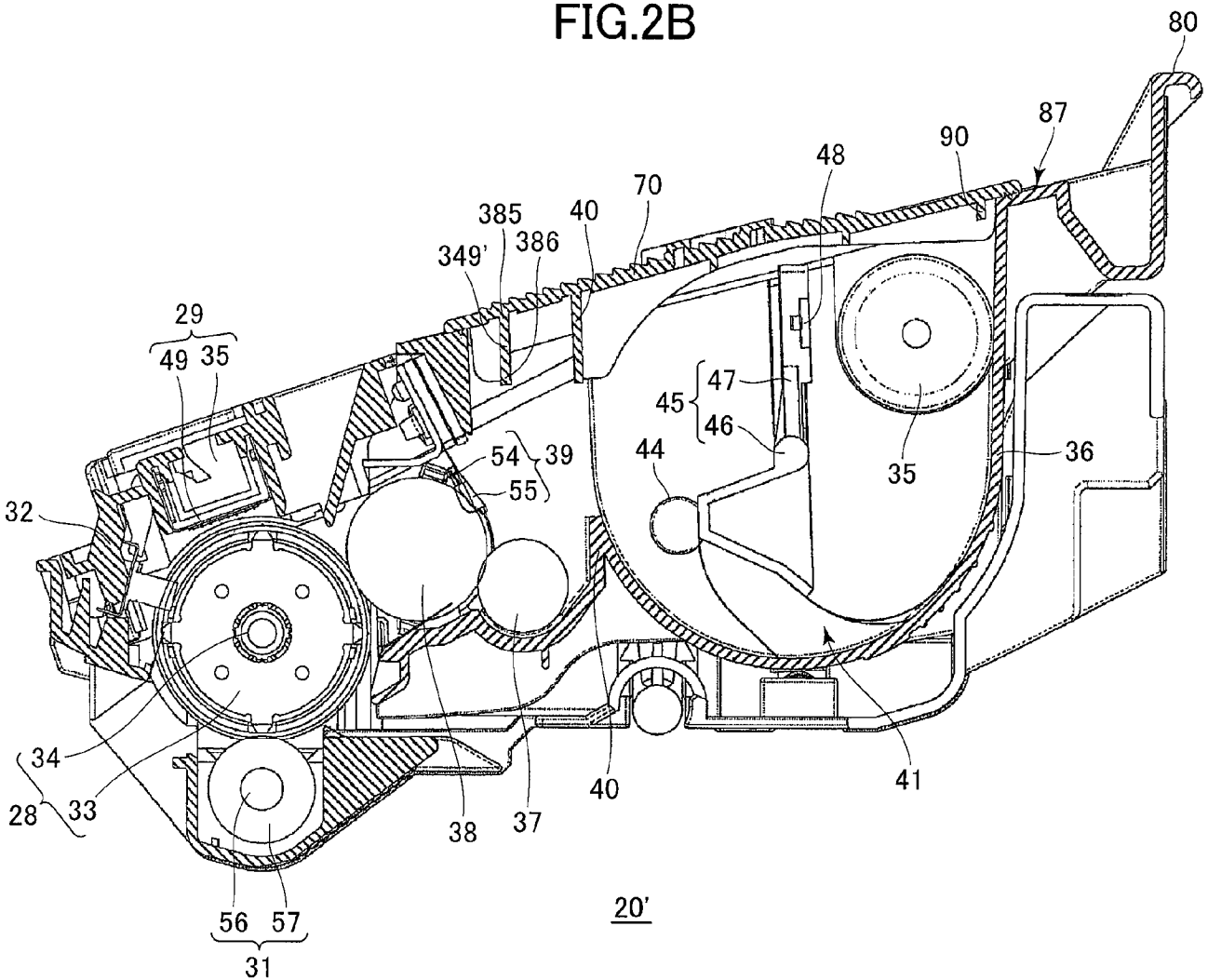
FIG. 2B is a side cross-sectional view of another process cartridge usable in the laser printer shown in FIG. 1 in lieu of the process cartridge shown in FIG. 2A.

The process cartridge 20 and developer cartridge 30 described by way of illustrative examples include the plate wall 349 extending vertically downward from the base end 385 toward the supply roller 37 so that the free end 386 of the plate wall 349 is positioned close to the peripheral surface of the supply roller 37. However, the process cartridge 20 or the developer cartridge 30 may be modified as shown in FIG. 2B while yet retaining many of the novel features and advantages above-described above. In the modified process cartridge 20' shown in FIG. 2B, the vertical length of the plate wall 349' is shortened relative to that of the plate wall 349 shown in FIGS. 2A, 11, 12 and 15 so that the free end 386 of the plate wall 349' is spaced a greater distance apart from the peripheral surface of the supply roller 37.

The invention claimed is:

1. A developer cartridge comprising:

a developer-carrying roller having a peripheral surface on which developer is carried, the developer-carrying roller configured to be rotated about a rotational axis; and a casing that has an opening formed therein and supports the developer-carrying roller in an exposed position in the opening, the opening having an edge extending in a direction parallel to the rotational axis, the casing including a reinforcing member that is substantially formed in a single box-shape having a length substantially equal to a length of the developer-carrying roller in a direction parallel to the rotational axis and is integrally provided with the edge of the opening for reinforcing the edge, the casing being formed of a resin, the reinforcing member being integrally provided with a first wall, a second wall, a third wall, and a fourth wall, the first wall extending along the edge of the opening and having a first end and a second end opposite to the first end in a direction that the first wall extends, the second wall extending along the edge of the opening and facing the first wall and having a third end and a fourth end opposite to the third end in a direction that the second wall extends, the third wall connecting the first end and the third end, the fourth wall connecting the second end and the fourth end.

2. The developer cartridge according to claim 1, wherein the reinforcing member further includes a fifth wall extending along the edge of the opening and connecting the first wall and the second wall, wherein the first wall, the second wall, and the fifth wall form three sides of a rectangle in a cross section orthogonal to a direction following a longitudinal edge of the opening.

3. The developer cartridge according to claim 1, wherein the first wall and the second wall extend along the rotation axis of the developing roller.

4. The developer cartridge according to claim 1, further comprising a film member that is provided on the edge of the opening and is configured to block a gap between the edge of the opening and the developer-carrying roller in order to prevent developer from leaking through the gap.

5. The developer cartridge according to claim 4, wherein the edge of the opening has a step formation including a plurality of steps in a cross section orthogonal to a direction along the edge of the opening, and wherein the film member is fixed to a step upstream of the step farthest downstream in a direction that developer leaks through the opening so as to be aligned with a downstream edge of the upstream step.

6. The developer cartridge according to claim 1, wherein the developer-carrying roller is supported in the casing so as to project out of the casing via the opening formed therein.

7. The developer cartridge according to claim 1, wherein the casing comprises a guide member that is formed continuously with the reinforcing member and guides a recording medium while a developer image formed of developer carried on the developer-carrying roller is transferred onto the recording medium.

8. The developer cartridge according to claim 7, wherein a plurality of the guide members is provided, and the guide members are spaced at intervals in a direction intersecting an extended direction of the reinforcing member.

9. A process cartridge comprising:

the developer cartridge according to claim 1; and an image-carrying member that is disposed in opposition to the developer-carrying roller and is configured to receive developer supplied from the developer-carrying member, and carry an electrostatic latent image that is developed into a visible image by the developer.

10. The process cartridge according to claim 9, wherein the developer-carrying roller is disposed in confrontation with the image-carrying member in a diagonal direction so that a part of the developer-carrying member other than the part projecting farthest out of the casing through the opening formed therein contacts the image-carrying member.

11. An image-forming device comprising:

a process cartridge receiving portion; and the process cartridge according to claim 9, wherein the process cartridge is detachably mounted in the process cartridge receiving portion.

12. An image-forming device comprising:

a developer cartridge receiving portion; and the developer cartridge according to claim 1, wherein the developer cartridge is detachably mounted in the developer cartridge receiving portion.

* * * * *